US009200647B2

(12) United States Patent
Jadhav et al.

(10) Patent No.: US 9,200,647 B2
(45) Date of Patent: Dec. 1, 2015

(54) PRE- AND POST- COMPENSATIONAL VALVE ARRANGEMENT

(71) Applicant: Eaton Corporation, Cleveland, OH (US)

(72) Inventors: Mahesh Kallapparao Jadhav, Pune (IN); Robin Francis Ireton, Searcy, AR (US)

(73) Assignee: Eaton Corporation, Cleveland, OH (US)

( * ) Notice: Subject to any disclaimer, the term of this patent is extended or adjusted under 35 U.S.C. 154(b) by 649 days.

(21) Appl. No.: 13/630,751

(22) Filed: Sep. 28, 2012

(65) Prior Publication Data

US 2013/0112297 A1 May 9, 2013

Related U.S. Application Data

(60) Provisional application No. 61/541,560, filed on Sep. 30, 2011.

(51) Int. Cl.
*F15B 13/04* (2006.01)
*F15B 11/16* (2006.01)
*F17D 3/00* (2006.01)

(52) U.S. Cl.
CPC ..... *F15B 11/163* (2013.01); *F15B 13/0417* (2013.01); *F17D 3/00* (2013.01); *Y10T 137/0402* (2015.04); *Y10T 137/85978* (2015.04)

(58) Field of Classification Search
CPC ... F15B 11/163; F15B 11/165; F15B 13/0417
USPC ..... 91/446; 60/422
See application file for complete search history.

(56) References Cited

U.S. PATENT DOCUMENTS 4,519,420 A 5/1985 Petro
4,693,272 A 9/1987 Wilke
5,579,642 A * 12/1996 Wilke et al. ..... 91/446
7,770,596 B2 8/2010 Christensen et al.
7,854,115 B2 12/2010 Pack et al.

OTHER PUBLICATIONS

Casey, B., "Understanding Load-sensing Control," *Machinery Lubrication*, http://www.machinerylubrication.com/Articles/Print/859, 4 pages (Mar. 2006).
PVG 100 Proportional Valves Service Manual, Sauer Danfoss, 44 pages (Nov. 2010).
International Search Report and Written Opinion for PCT/US2012/057923 mailed Mar. 15, 2013.

* cited by examiner

*Primary Examiner* — Michael Leslie
(74) *Attorney, Agent, or Firm* — Merchant & Gould P.C.

(57) ABSTRACT

Hydraulic valve arrangements may be assembled to provide pre-compensation or post-compensation using the same chassis body. A first type of main spool is disposed in a main passage and a first type of pressure compensator spool is disposed in a compensator passage to provide pressure pre-compensation. The first type of pressure compensator spool connects to a first pilot location and not to a second pilot location. A second type of main spool is disposed in the main passage and a second type of pressure compensator spool is disposed in the compensator passage to provide pressure post-compensation. The second type of pressure compensator spool connects to the second pilot location and not to the first pilot location. The valve arrangement may be switched from pre-compensation to post-compensation (or vice versa) by switching out the main spool and pressure compensator spool without making any other changes to the chassis body.

27 Claims, 21 Drawing Sheets

PRE- AND POST- COMPENSATIONAL VALVE ARRANGEMENT

CROSS REFERENCE TO RELATED APPLICATIONS

This application claims the benefit of U.S. Provisional Application No. 61/541,560, filed Sep. 30, 2011, and titled "Pre- and Post-Compensational Valve Arrangement," the disclosure of which is hereby incorporated herein by reference.

TECHNICAL FIELD

The disclosure is directed to a hydraulic valve arrangement having a supply channel port, a tank return port, at least one working port, a directional valve arrangement between the supply channel port and the working port, and a compensation arrangement.

BACKGROUND

Compensation valve arrangements regulate flow through a directional valve arrangement between a supply port and one or more work ports. Such valve arrangements may be used to actuate hydraulic drives (e.g., hydraulic cylinders, hydraulic motors, etc.) in working machines, vehicles, or other hydraulically-operated systems. For example, in a backhoe, a first hydraulic drive can be used to tilt a beam in relation to a chassis; a second hydraulic drive can be used to tilt an arm in relation to the beam; a third hydraulic drive can be used to activate a shovel; and a fourth hydraulic drive can be provided to turn the upper vehicle body in relation to the lower vehicle body.

In general, compensation arrangements are provided in load sensing valves to maintain constant pressure drop across a metering orifice created by spool movement. Accordingly, the flow of the hydraulic fluid from the supply channel arrangement to the connected hydraulic drive depends on the opening degree of the directional valve arrangement. Thus, a practically proportional function of the directional valve arrangement is obtained.

Some types of compensation valve arrangements have the compensator located upstream of the metering orifice. These types of compensation valve arrangements are referred to as "pre-compensation valve arrangements." Pre-compensation valve arrangements are configured to sense the pressure at an individual work port and to compare the sensed work port pressure against the pressure at an outlet of the compensator (i.e., the compensated pressure). During flow saturation (i.e., when the demand is greater than the pump is supplying), the pre-compensation valve arrangement gives priority to lower load drive. However, the pre-compensation valve arrangement slows or even stops higher load drive.

Some types of compensation valve arrangements have the compensator located downstream of the metering orifice. These types of compensation valve arrangements are referred to as "post-compensation valve arrangements." Post-compensation valve arrangements are configured to sense the highest pressure of all of the work ports and to compare the sensed pressure against the pressure at an inlet of the compensator. During flow saturation, the post-compensation valve arrangement proportionally reduces the speed of all drives connected to the system per the opening of the metering orifices. The post-compensation arrangement does not stop the highest load drive. However, the post-compensation valve arrangement does not provide priority to any of the drives.

SUMMARY

Aspect of the present disclosure relate to a hydraulic valve arrangement that may be selectively assembled to provide pre-compensation to fluid flow or post-compensation to fluid flow using the same chassis body. The chassis body defines a directional circuit and a compensation circuit. The directional circuit includes a pump input port, a tank return port, a main spool bore, and at least one work port. The compensation circuit includes a compensation spool bore at which a first load sense pilot pressure input location and a second load pilot pressure input location are located.

In accordance with some aspects, a first type of main spool is disposed in the main spool bore and a first type of compensator spool is disposed in the compensator spool bore to provide pre-compensation to fluid flow. The first type of compensator spool is structured to connect to the first load sense pilot pressure input location and not to the second load sense pilot pressure input location.

In accordance with other aspects, a second type of main spool is disposed in the main spool bore and a second type of compensator spool is disposed in the compensator spool bore to provide post-compensation to fluid flow. The second type of compensator spool is structured to connect to the second load sense pilot pressure input location and not to the first load sense pilot pressure input location.

In accordance with certain aspects, the hydraulic valve arrangement may be switched from a pre-compensation system to a post-compensation system (or vice versa) by switching out the main spool and compensator spool without making any other changes to the chassis body.

In accordance with certain aspects, an example hydraulic load sense flow control system interfaces with a pump. In some implementations, the pump is a variable displacement pump having load sense control. In other implementations, the pump is a fixed displacement pump in an open center system including an unloader valve having load sense control. The hydraulic flow control system includes a valve body; a directional flow control spool; and a compensation spool. A valve body defines a main spool bore, a compensation spool bore, a pump port, a tank port, and a working port. Some valve bodies also include additional cavities, if required, for shock and anti-cavitation valves. The pump port is configured to receive pump flow.

The valve body includes a drive circuit for directing pump flow from the pump port to the working port. The valve body also defines first and second separate load sense pilot pressure input locations at the compensation spool bore. The valve body also defines a load sense circuit for: a) communicating a load sense control pressure to a load sense port adapted to be connected to the drive circuit; b) communicating the load sense control pressure to the second load sense pilot pressure input location; and c) communicating a localized working pressure of the working port to the first load sense pilot pressure input location. The directional flow control spool mounts in the main spool bore and is configured to control the pump flow provided to the working port by the drive circuit. The compensation spool mounts in the compensation spool bore and is configured to provide compensation to the pump flow directed through the drive circuit. The compensation spool has a first pilot surface that is in fluid communication with one of the first and second load sense pilot pressure input locations and that is blocked from fluid communication with the other of the first and second load sense pilot pressure input locations.

In some implementations, the load sense port is adapted to be connected to the load sense control of the variable displacement pump of the drive circuit. In other implementations, the load sense port is adapted to be connected to the load sense control of an unloader valve in an open center system having a fixed displacement pump.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

BRIEF DESCRIPTION OF THE DRAWINGS

The accompanying drawings, which are incorporated in and constitute a part of the description, illustrate several aspects of the present disclosure. A brief description of the drawings is as follows.

DETAILED DESCRIPTION

Referring now to the figures in general, an example hydraulic section valve assembly includes a chassis body that may be selectively configured with a pre-compensation arrangement or a post-compensation arrangement. The same chassis body can accommodate either the pre-compensation arrangement or the post-compensation arrangement without altering the chassis body. Accordingly, manufacturers can accommodate demand for both types of valve assemblies while manufacturing only one chassis body design, thereby enhancing manufacturing efficiency.

Figure 1:
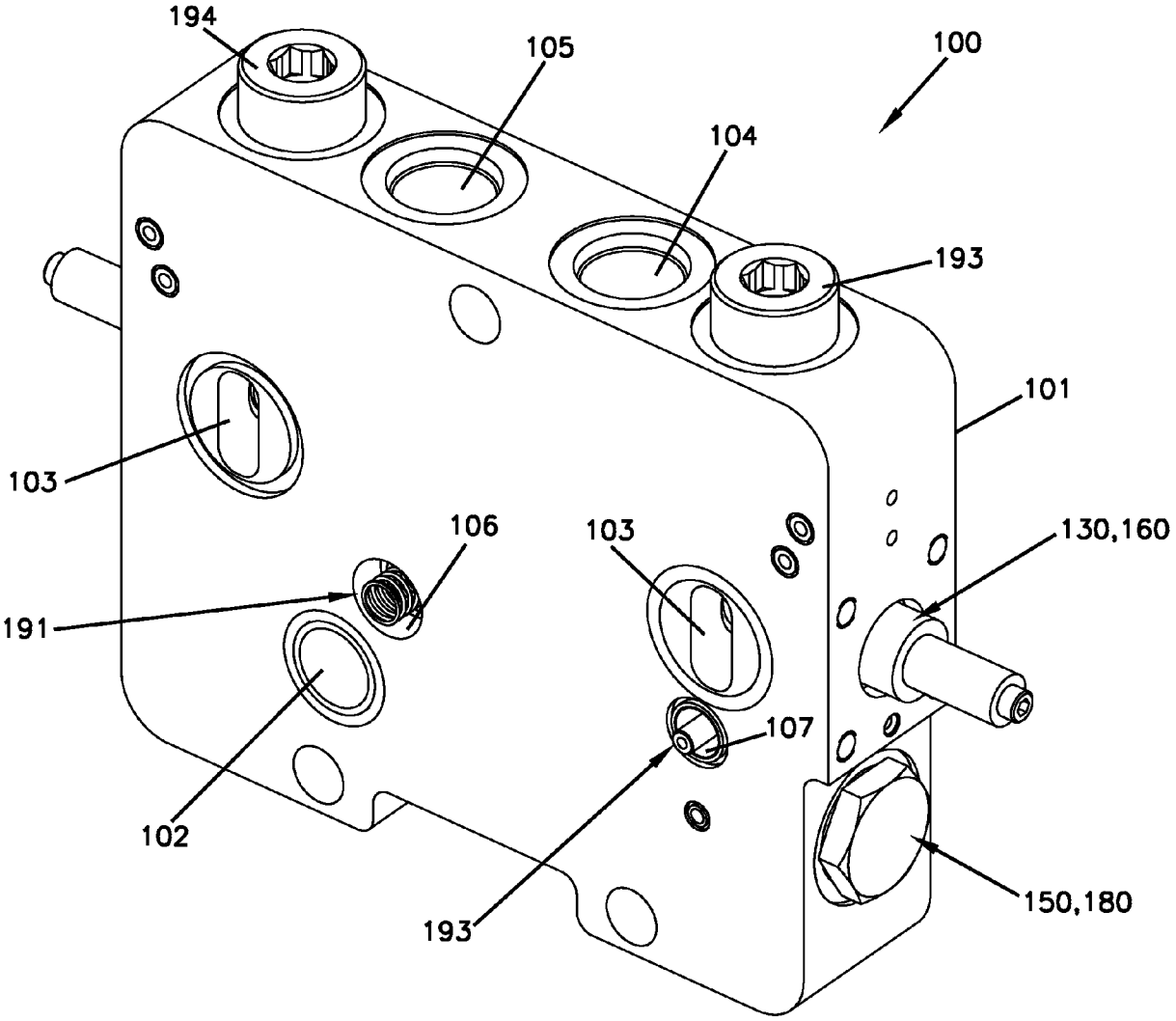
FIG. 1 is a perspective view of an example compensation subsection of a hydraulic system including a chassis body, a main spool arrangement, and a compensation spool arrangement in accordance with the principles of the disclosure.
Figure 4:
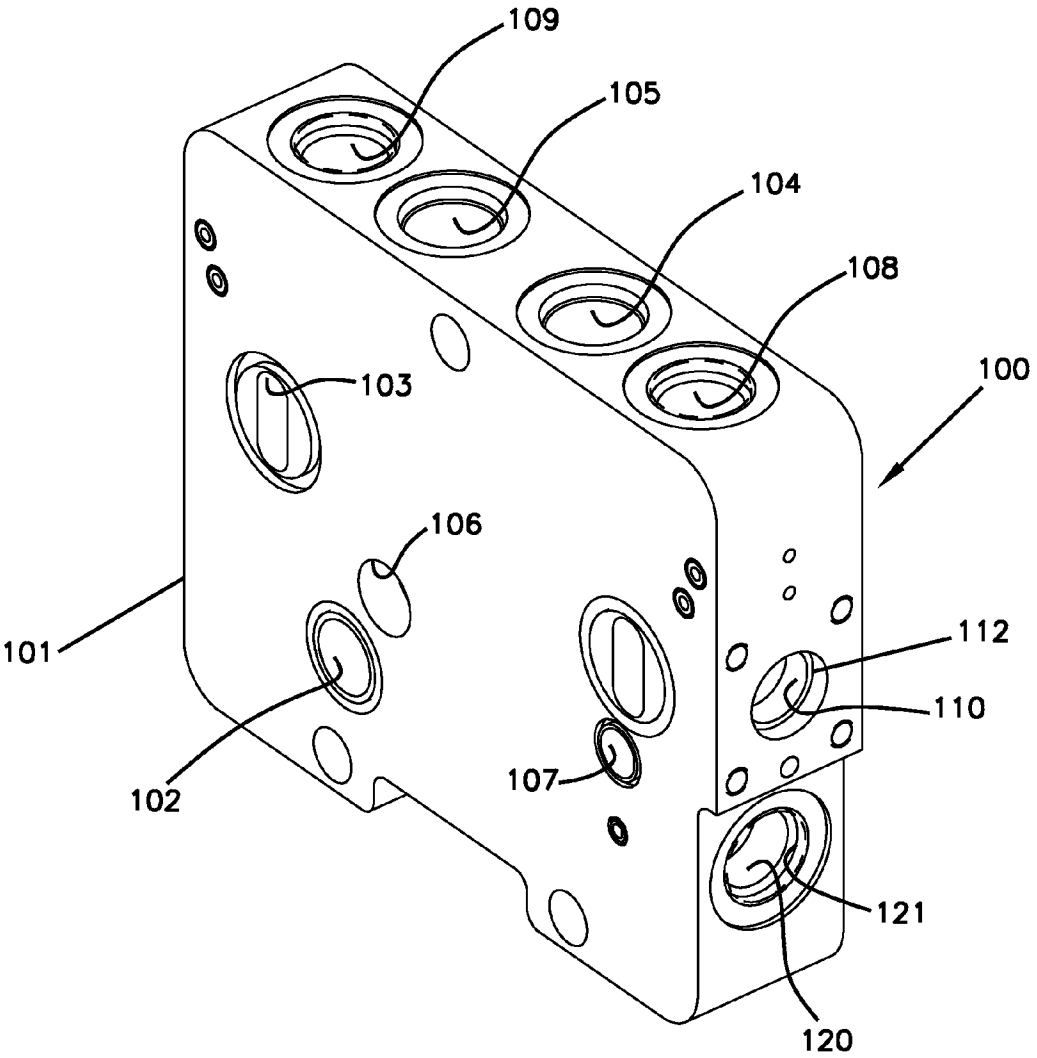
FIG. 4 is a perspective view of the example chassis body of FIG. 1.

As shown in FIG. 1, an example chassis body 101 of an example hydraulic valve assembly 100 defines a drive circuit including a main spool passage 110 (i.e., a main spool bore shown in FIG. 4) and a compensator spool passage 120 (i.e., a compensator spool bore shown in FIG. 4). The chassis body 101 also defines a load sense circuit including a first load sense pilot pressure input location (which communicates a local working port pressure) and a second load sense pilot pressure input location (which communicates the pressure at the work port having the highest pressure in the system) located at the compensator spool passage 120. The second load sense pilot pressure input location is separated (e.g., axially separated) from the first load sense pilot pressure input location.

Figure 6:
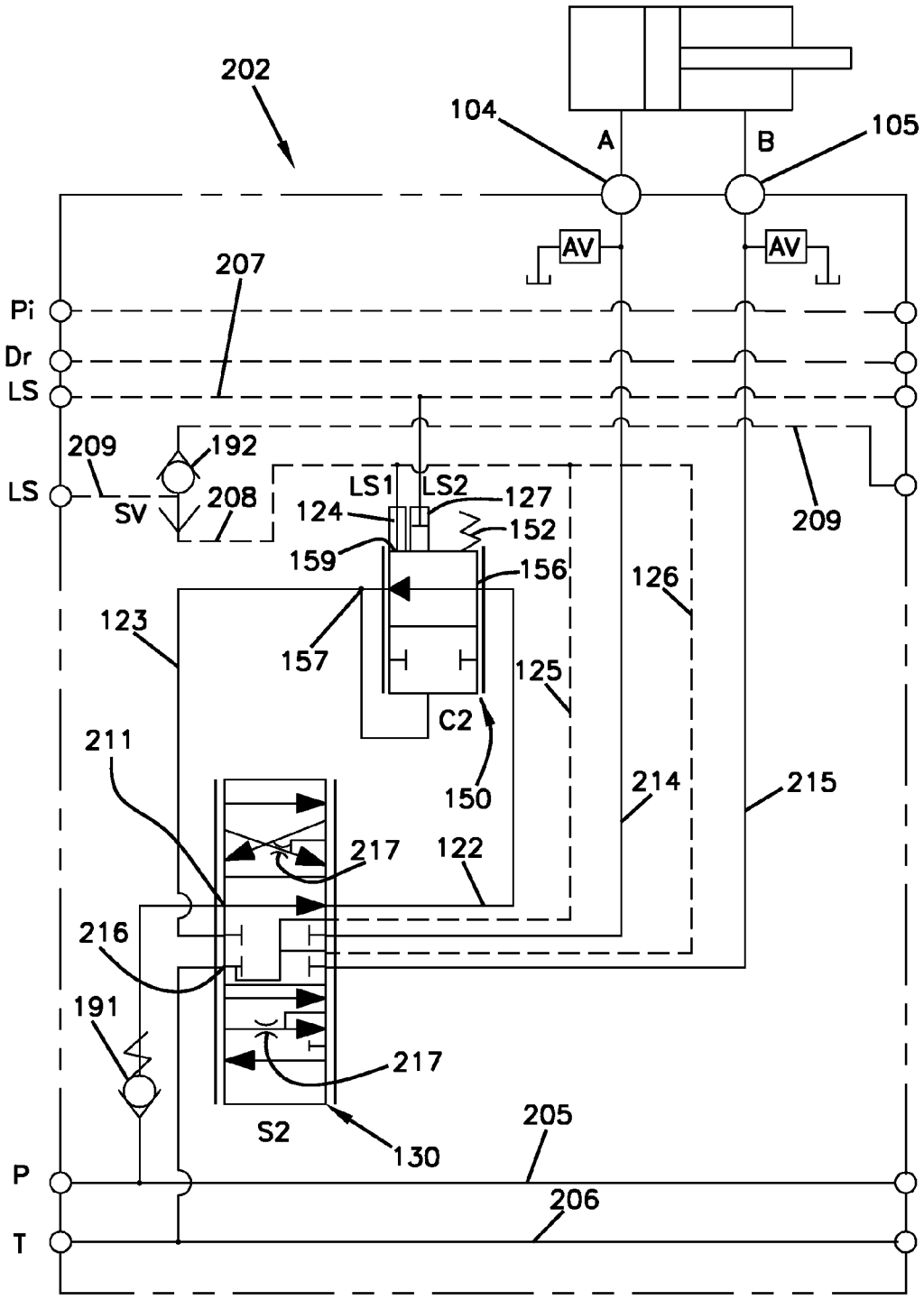
FIG. 6 is a flow circuit diagram of an example pre-compensation valve assembly in accordance with the principles of the disclosure.
Figure 7:
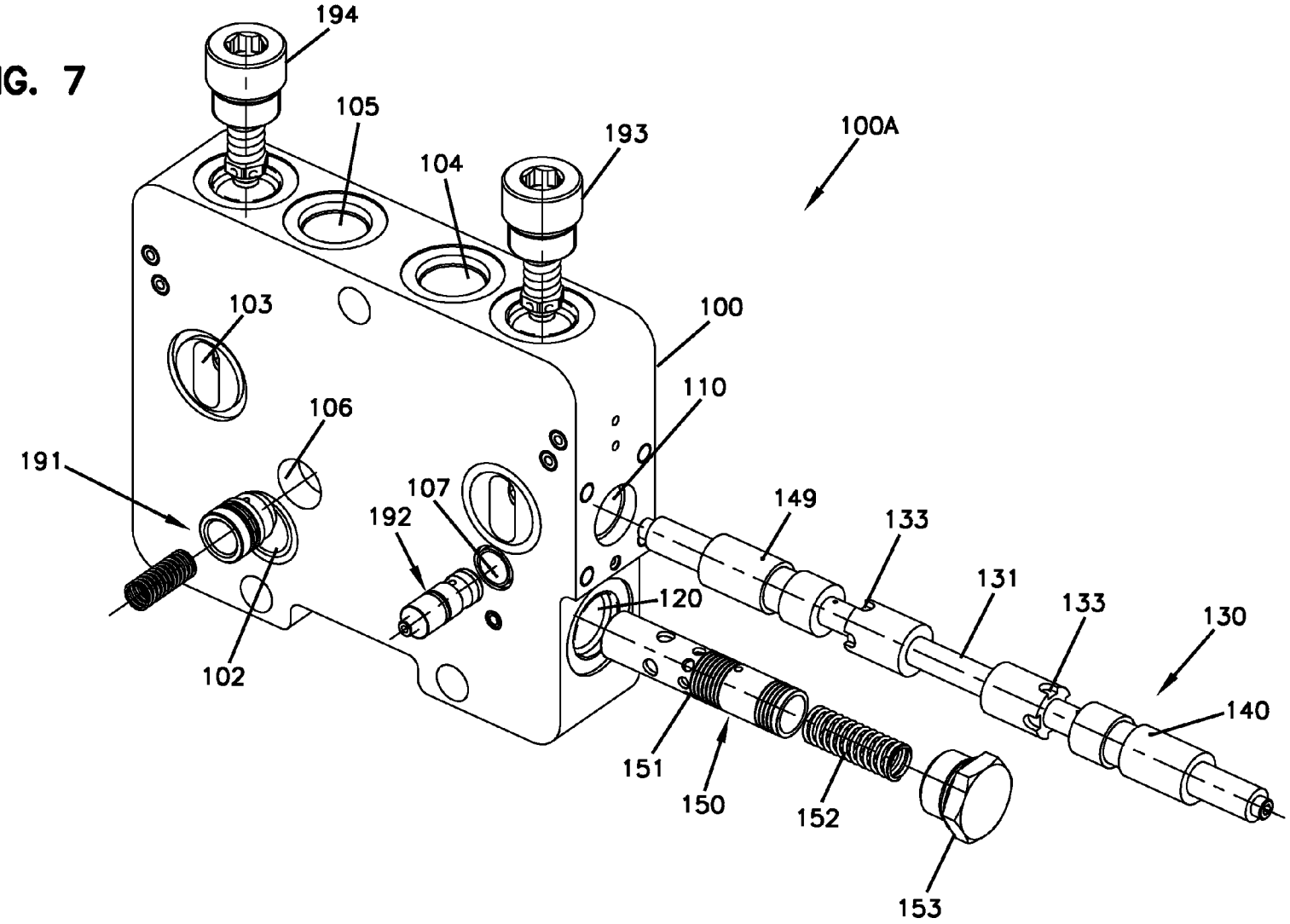
FIG. 7 is a perspective view of an example pre-compensation subsection of an example hydraulic system having the pre-compensation spool arrangement and the main spool arrangement exploded from the chassis body along with the load drop check assembly, the shuttle valve, and the shock valves.

To provide pre-compensation, a first type of main spool 130 is disposed in the main spool passage 110 and a pre-compensator spool arrangement 150 is disposed in the compensator spool passage 120 (see FIG. 7). The pre-compensation spool arrangement 150 has a pilot surface in fluid communication with the first load sense pilot pressure input location and blocked from fluid communication with the second load sense pilot pressure input location (see FIG. 6). To provide post-compensation, a second type of main spool arrangement 160 is disposed in the main spool passage 110 and a post-compensator spool arrangement 180 is disposed in the compensator spool passage 120 (see FIG. 15). The post-compensation spool arrangement 180 has a pilot surface in fluid communication with the second load sense pilot pressure input location and blocked from fluid communication with the first load sense pilot pressure input location (see FIG. 14).

Figure 2:
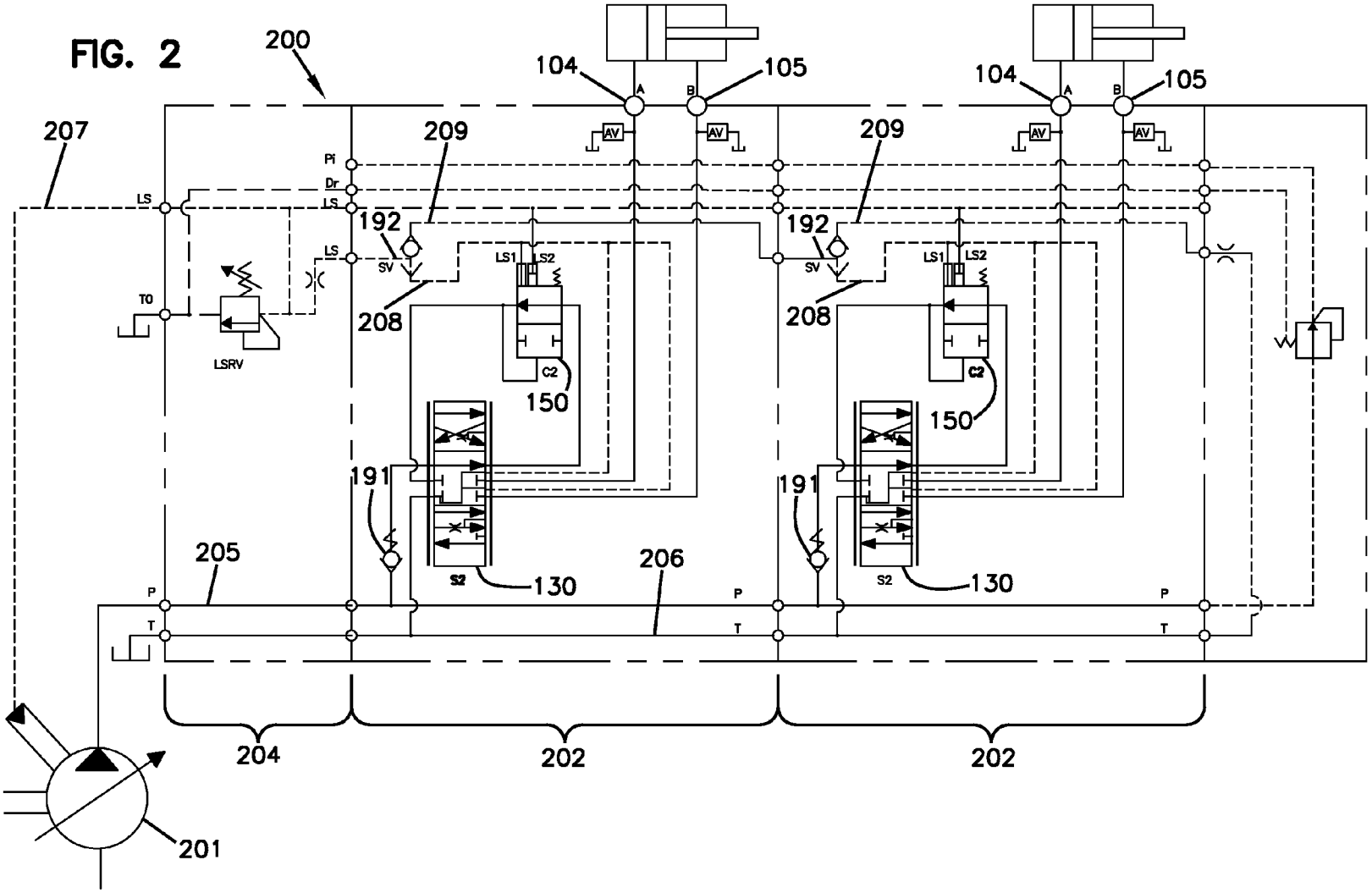
FIG. 2 is a flow circuit diagram of a hydraulic system including two pre-compensation valve assemblies and a load sense relief valve in accordance with the principles of the disclosure.
Figure 3:
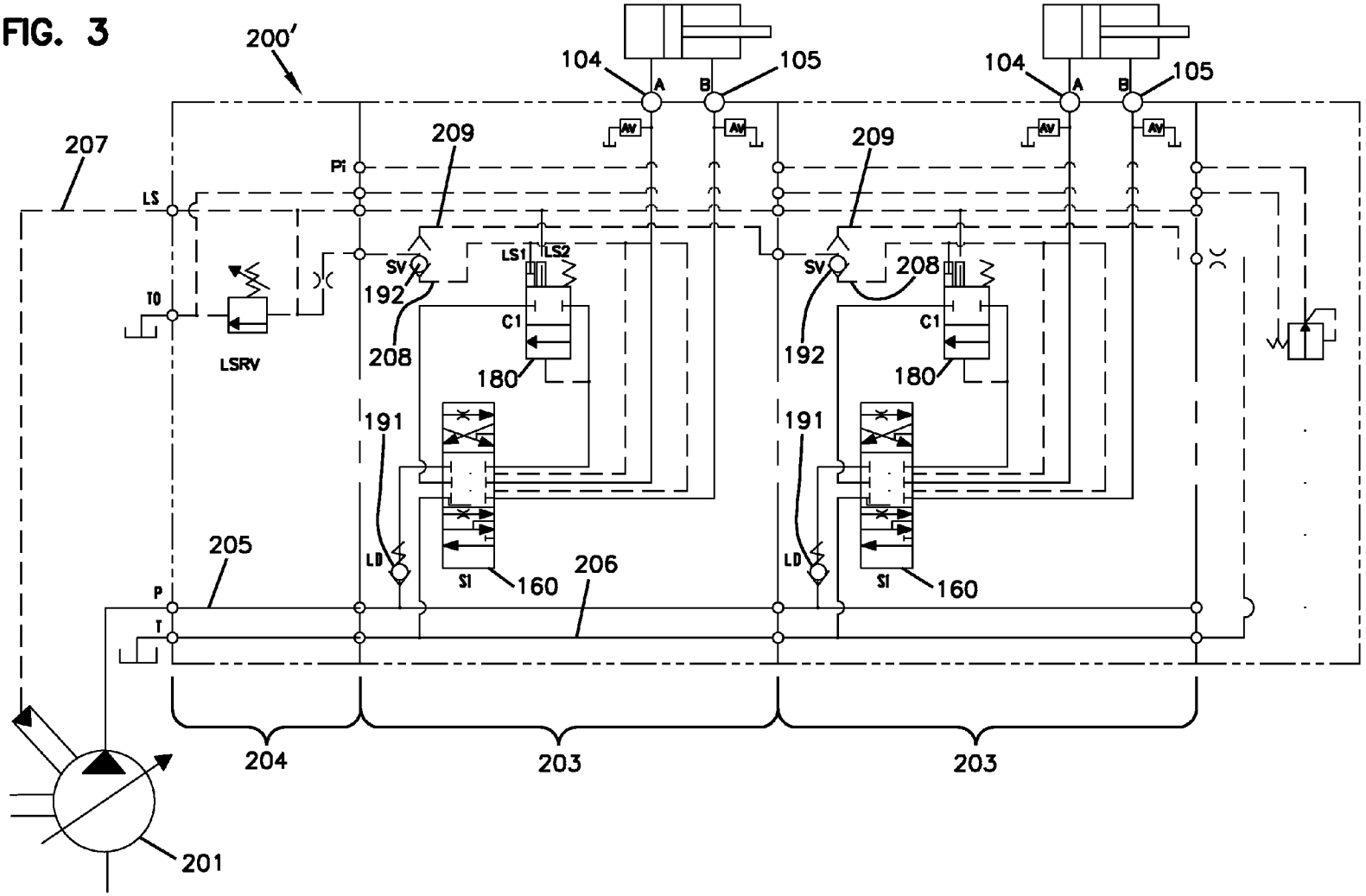
FIG. 3 is a flow circuit diagram of a hydraulic system including two post-compensation valve assemblies and a load sense relief valve in accordance with the principles of the disclosure.

FIGS. 2 and 3 are circuit diagrams showing example hydraulic valve systems 200, 200' including one or more sub-sections. At least one of the sub-sections (e.g., a compensation sub-section) includes a drive circuit and a compensation circuit. Each compensation sub-section may be implemented with the hydraulic valve assembly 100 of FIG. 1. Each compensation sub-section can be either a pre-compensation sub-section 202 or a post-compensation sub-section 203. Each of the hydraulic valve systems 200, 200' includes a pump arrangement 201 connected to a supply line 205, a return line 206, and a load sense line 207. These lines 205-207 travel between various sub-sections (e.g., hydraulic valve assemblies 100) and a load sense relief section 204.

In some implementations, the pump arrangement 201 includes a variable displacement pump having a load sense control. In other implementations, the pump arrangement 201 includes a fixed displacement pump. For example, the pump arrangement 201 may include a fixed displacement pump in an open center system that also includes an unloader valve having load sense control. In other implementations, the pump arrangement 201 may include any desired type of pump and valve arrangement that enables alternation of the flow based on load sense control.

The hydraulic valve systems 200, 200' each include a load sense circuit that connects all of the work ports 104, 105 of the hydraulic valve systems 200, 200' through a series of shuttle valves 192 so that the actuator with the highest load pressure is sensed and fed back to the load sense controller of the pump arrangement 201. The load sense circuit includes a load sense line 207 that receives the output from the series of shuttle valves 192 and inputs to the pump control. The load sense circuit also includes at least one work port pressure line 208 in each sub-section. Each work port pressure line 208 connects the active working port 104, 105 to the shuttle valve 192 of the respective sub-section. The load sense circuit also includes a bypass line 209 that carries the output of the previous shuttle valve 192 to the local shuttle valve. Accordingly, each shuttle valve 192 outputs the higher of the local working port pressure and the highest working port pressure sensed at a previous sub-section.

In use, the pump arrangement 201 supplies pressurized fluid to the supply line 205, which routes the fluid to the various sub-sections. At each compensation sub-section 202, 203, the supply line 205 routes the fluid through a load drop check assembly 191 to a directional valve assembly 130, 160. The directional valve assembly 130, 160 controls the direction of fluid flow to work port 104, 105 of the sub-section. The fluid passes through a compensation valve assembly 150, 180 when routed to any of the work ports 104, 105. The compensation valve assembly 150, 180 is configured to selectively open or close to regulate the fluid flow through the work port 104, 105. Each compensation valve assembly 150, 180 is configured to use either the pressure in the load sense line 207 or the local pressure at the active working port 104, 105 (i.e., the working port receiving the pressurized fluid) as will be disclosed in more detail herein. The load sense line 207 is routed back to the load sense control control of the pump arrangement 201 to manage the supply flow (i.e., the volume or rate of change in fluid displacement) within the drive circuit.

As shown in FIG. 2, a first example hydraulic system 200 includes at least one pre-compensation sub-section 202. In the example shown, the first hydraulic system 200 includes two pre-compensation sub-sections 202. In other implementations, however, the first hydraulic system 200 may include a greater number of pre-compensation sub-sections 202 (e.g., three, four, six, ten, twelve, etc.). Each pre-compensation sub-section 202 includes a directional valve assembly 130 that defines a restriction/metering orifice downstream of the pre-compensation valve arrangement 150.

The pre-compensator valve arrangement 150 opens and closes based on pressure differential between the outlet pressure of the pre-compensator valve arrangement 150 and the pressure in the work port pressure line 208. When the valve is operated, the pressure in the work port pressure line 208 is the same as the pressure at the active working port 104 or 105. The pre-compensator valve arrangement 150 does not compare the pressure at the pre-compensator valve arrangement 150 against the pressure in the load sense line 207. As shown in FIG. 2, the connection to the load sense line 207 is blocked at the pre-compensator arrangement 150.

As shown in FIG. 3, the second hydraulic system 200' includes at least one post-compensation sub-section 203. In the example shown, the second hydraulic system 200' includes two post-compensation sub-sections 203. In other implementations, however, the second hydraulic system 200' may include a greater number of post-compensation sub-sections 203 (e.g., three, four, six, ten, twelve, etc.). Each post-compensation sub-section 203 includes a directional valve assembly 160 that defines a restriction/metering orifice upstream of the post-compensation valve arrangement 180.

The post-compensator valve arrangement 180 opens and closes based on pressure differential between the inlet pressure of the post-compensator valve arrangement 180 and the pressure in the load sense line 207. As noted above, the pressure in the load sense line 207 is the pressure at the working port 104, 105 having the highest pressure of all working ports in the second hydraulic system 200'. The post-compensator valve arrangement 180 does not compare the pressure at the post-compensator valve arrangement 180 against the pressure in the work port pressure line 208. As shown in FIG. 3, the connection to the work port pressure line 208 is blocked at the post-compensator arrangement 180.

The hydraulic chassis body 101 is configured into either a pre-compensation sub-section assembly 202 or a post-compensation sub-section assembly 203 based on the main spool 130, 160 and the compensator spool arrangement 150, 180. Accordingly, a manufacturer is able to assemble either type of compensation system using only one type of chassis body 101. Furthermore, the hydraulic chassis body 101 can be configured into a pre-compensation assembly 202 and subsequently retrofit as a post-compensation assembly 203 by removing the main spool 130 and compensator spool 150 configured for pre-compensation and replacing them with a main spool 160 and compensator spool 180 configured for post-compensation. Likewise, the hydraulic chassis body 101 can be configured into a post-compensation assembly 203 and subsequently retrofit as a pre-compensation assembly 202 by removing the main spool 160 and compensator spool 180 configured for post-compensation and replacing them with a main spool 130 and compensator spool 150 configured for pre-compensation.

In accordance with some aspects, the chassis body 101 of FIG. 1 forms one of the compensation subsections of a hydraulic system (e.g., pre-compensation sub-section 202 of hydraulic system 200 or post-compensation sub-section 203 of hydraulic system 200'). The chassis body 101 defines a drive circuit including a supply line inlet 102, at least one return line outlet 103, and at least one working port, each of which connects to the main spool passage 110. In the example shown, the drive circuit includes two working ports 104, 105.

Each type of main spool 130, 160 is configured to slide within the main spool passage 110 between at least two axial positions to form a directional valve to selectively route fluid flow between the ports. For example, in various embodiments, the main spool 130, 160 may be moved by a solenoid, hydraulic pilot pressure, pneumatic pilot pressure, by springs, or by hand. The first type of main spool 130 is configured to provide a metering orifice downstream of the pre-compensator spool arrangement 150 as will be disclosed herein. The second type of main spool arrangement 160 is configured to provide a metering orifice upstream of the post-compensator spool arrangement 180 as will be disclosed herein.

In certain implementations, the chassis body 101 defines two working ports 104, 105 so that the main spool 130, 160 alternately connects the supply line inlet 102 to the working ports 104, 105 by moving between two or more positions. The main spool 130, 160 selectively allows and blocks fluid flow between the supply line inlet 102 and the working port 104, 105 by moving between the two or more positions. For example, in a first position, the main spool 130, 160 may connect the supply line inlet 102 to a first working port 104 and the return line outlet 103 to a second working port 105; and in a second position, the main spool 130, 160 may connect the supply line inlet 102 to the second working port 105 and the return line outlet 103 to the first working port 104. In certain implementations, the main spool 130, 160 is configured to slide between at least three axial positions as will be disclosed in more detail herein.

The chassis body 101 also defines a compensator spool passage 120 in which any of the compensator spool arrangements 150, 180 may slide. The compensator spool arrangement 150, 180 includes a spring 152, 182 that biases a compensator spool 151, 181 into the passage 120. The spring 152, 182 of each compensator arrangement 150, 180 is positioned at the open end 121 of the compensator passage 120 and biases the spool 151, 181 towards the closed end of the passage 120.

In general, the compensator spool arrangement 150, 180 is configured to slide within the compensator spool passage 120 between open and closed positions based on pressure differences between the fluid flow at selected locations along the drive circuit and a combination of spring pressure and a load-based pressure. In particular, the pre-compensator spool arrangement 150 slides based on pressure differences between the compensator spool outlet and a combination of the spring pressure and a first load sense pilot pressure input location as will be disclosed in more detail herein. The post-compensator spool arrangement 180 slides based on pressure differences between the compensator spool inlet and a combination of the spring pressure and a second load sense pilot pressure input location pressure as will be disclosed in more detail herein.

Figure 5:
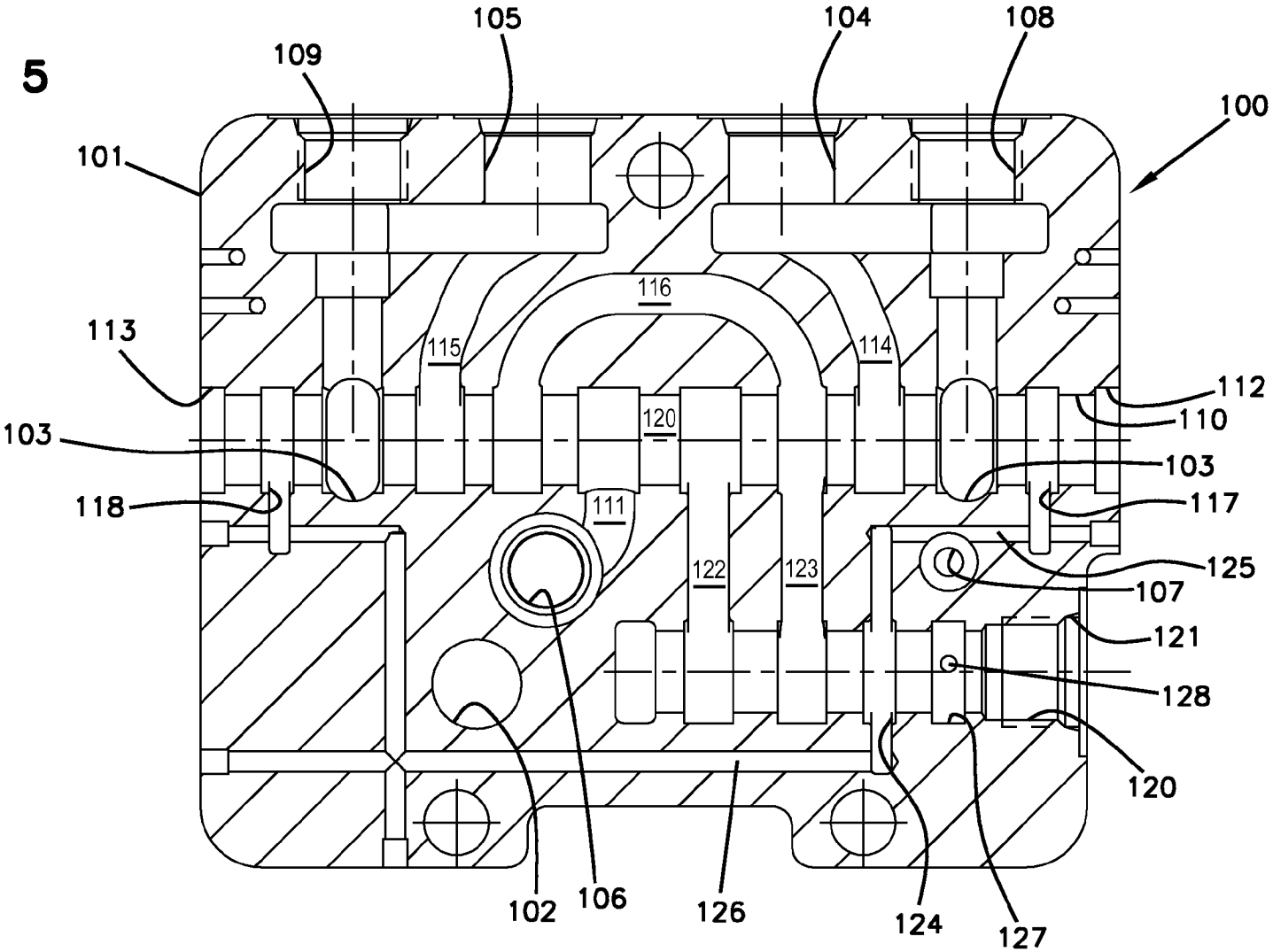
FIG. 5 is a cross-sectional view of the chassis body of FIG. 4.

FIGS. 4 and 5 show the chassis body 101 of the hydraulic sub-system 100. The chassis body 101 defines a plurality of passages through which hydraulic fluid may flow. As shown in FIG. 4, the chassis body 101 defines a supply line inlet 102 for supply line 205, at least one return line outlet 103 for return line 206, and at least one working port 104, 105 that are accessible from an exterior of the chassis body 101. The chassis body 101 also defines a load drop chamber 106 and a shuttle valve chamber 107 to hold a load drop check assembly 191 (FIG. 1) and a shuttle valve 192 (FIG. 1) as will be disclosed in more detail herein. In certain implementations, the chassis body 101 also defines first and second valve chambers 108, 109 to hold first and second shock valves 193, 194, respectively (see FIG. 1).

In certain implementations, the chassis body 101 has a front, a back, a first side (e.g., a right side), a second side (e.g., a left side), a first end (e.g., a top), and a second end (e.g., a bottom). In the example shown in FIG. 4, the supply line inlet 102 and two return line outlets 103 are defined in the front of the chassis body 101. The load drop chamber 106 and shuttle valve chamber 107 also are defined in the front of the chassis body 101. The work ports 104, 105 are defined in the first end of the chassis body 101. The valve chambers 108, 109 also are defined in the first end of the chassis body 101. The main spool passage 110 has a first open end 112 at the first side of the chassis body 101 and a second open end 113 at the second side of the chassis body 101 (see FIG. 5). The compensator spool passage 120 has an open end 121 at the first side of the chassis body 101. In other implementations, however, the passages within the chassis body 101 may be disposed so that the various inlets and outlets are located at different sides of the chassis body 101.

In some implementations, two or more chassis bodies 101 may be disposed adjacent each other in a hydraulic valve system. In some such implementations, a supply line outlet and one or more return line inlets may be defined at the rear of the chassis body 101 to enable fluid flow between the adjacent chassis bodies 101. In other implementations, the supply lines 205, return lines 206, and load sense lines 207 may connect between non-adjacent chassis bodies 101 (e.g., via tubes, pipes, or other conduits). In still other implementations, each chassis body 101 may have a separate supply line 205 and/or return line 206 to the pump arrangement 201.

As shown in FIG. 5, the main spool passage 110 connects to the load drop chamber 106 via a pump inlet passage 111. The load drop chamber 106 connects to the supply line inlet 102 at a portion of the chassis body 101 not visible in FIG. 4. The return line outlets 103 also connect to the main spool passage 110. In the example shown, the return line outlets 103 are aligned with the valve chambers 108, 109. As noted above, in certain implementations, the main spool passage 110 extends from a first open end 112 at one side of the chassis body 101 to a second open end 113 at an opposite side of the chassis body 101. In other implementations, however, one or both ends of the main spool passage 110 may be closed.

A first work passage 114 leads from the main spool passage 110 to the first work port 104. A second work passage 115 leads from the main spool passage 110 to the second work port 105. A cross-over passage 116 connects a first section of the main spool passage 110 adjacent the first work passage 114 to a second section of the main spool passage 110 adjacent the second work passage 115. First and second load sense inlets 117, 118 are defined at the first and second ends 112, 113, respectively, of the main spool passage 110. In the example shown, the load sense inlets 117, 118 are each disposed between a respective return line outlet 103 and the respective end 112, 113 of the main spool passage 110.

The compensator spool passage 120 connects to the main spool passage 110 via a compensator inlet passage 122 and a compensator outlet passage 123. The compensator spool passage 120 also connects with a first load sense location 124 and to a second load sense location 127. The second load sense location 127 is spaced axially along the passage 120 from the first load sense location 124. A first load sense passage 125 connects the first load sense location 124 to the main spool passage 110 at the first end 112 and a second load sense passage 126 connects the first load sense location 124 to the main spool passage 110 at the second end 113. The first and second load sense passages 125, 126 form the work port pressure line 208 that leads to the shuttle valve 192. A load sense passage (not visible in FIG. 5) from the load sense line 207 defines an outlet 128 (FIG. 5) at the second load sense location 127.

FIG. 6 is a flow circuit diagram showing the fluid pathways of an example pre-compensation subsection 202 of a hydraulic system. The pre-compensation circuit includes the supply line 205, return line 206, and load sense line 207 of the hydraulic valve system 200. The pre-compensation circuit 202 also includes a directional valve 130 (e.g., main spool arrangement) and a compensation valve arrangement 150 (e.g., compensation spool arrangement 150). The directional valve 130 has three variable positions, each position corresponding to a different flow path arrangement. The compensation valve arrangement 150 has two variable positions—open and closed. In some implementation the directional valve 130 can have more or less then three positions.

The work port pressure line 208 connects to a pilot input 159 of the compensation valve arrangement 150 at a first load sense location 124. The work port pressure line 208 has the same pressure as whichever work port (e.g., work port 104 or work port 105) is connected to the supply line 205 by the directional valve 130. As indicated above, the load sense line 207 does not connect to the pre-compensation valve arrangement 150. However, the load sense line 207 is configured to receive the highest pressure (i.e., greatest load) of all of the work ports out of all of the compensation sub-sections of the hydraulic system. A shuttle valve 192 of each sub-section receives the work port pressure line 208 and the bypass line 209 and outputs the greater of the two to the subsequent shuttle valve 192. The final shuttle valve 192 outputs into the load sense line 207 for the system.

The directional valve 130 has a supply line input port 211 that connects to the supply line 205 (e.g., via inlet passage 111 of FIG. 5) and a return line outlet port 216 that connects to the return line 206 (e.g., via return line outlets 103). In certain implementations, a load drop check circuit 191 is disposed upstream of the supply line input port 211. The directional valve 130 also connects to the compensation valve arrangement 150 via the compensation inlet line 122 and the compensation outlet line 123. The directional valve 130 also connects to the work ports 104, 105. In the example shown, the directional valve 130 connects to a first work port 104 via a first work line 214 (e.g., work port passage 114 of FIG. 5) and to a second work port B via a second work line 215 (e.g., cross-over passage 116 and second work port passage 115 of FIG. 5). In other implementations, the directional valve 130 may connect to additional work ports.

Figure 9:
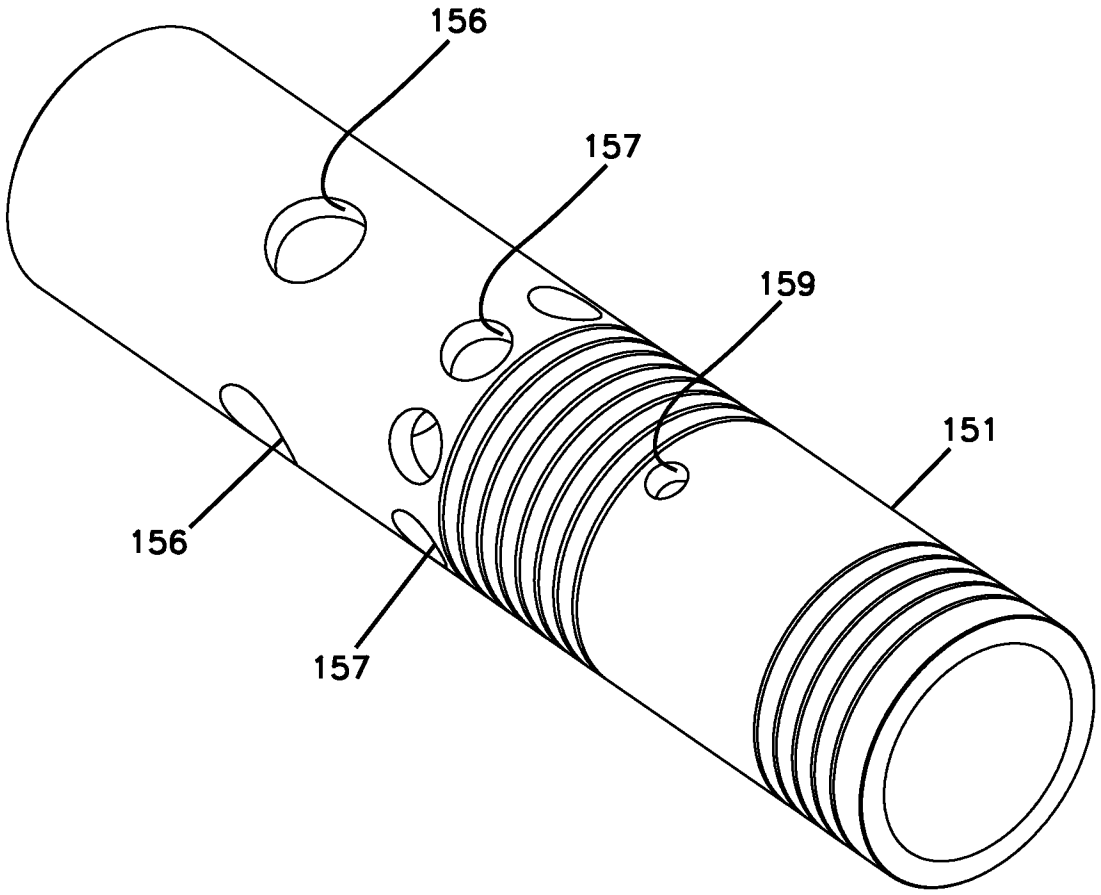
FIG. 9 is an enlarged view of the pre-compensation spool of FIG. 7.
Figure 10:
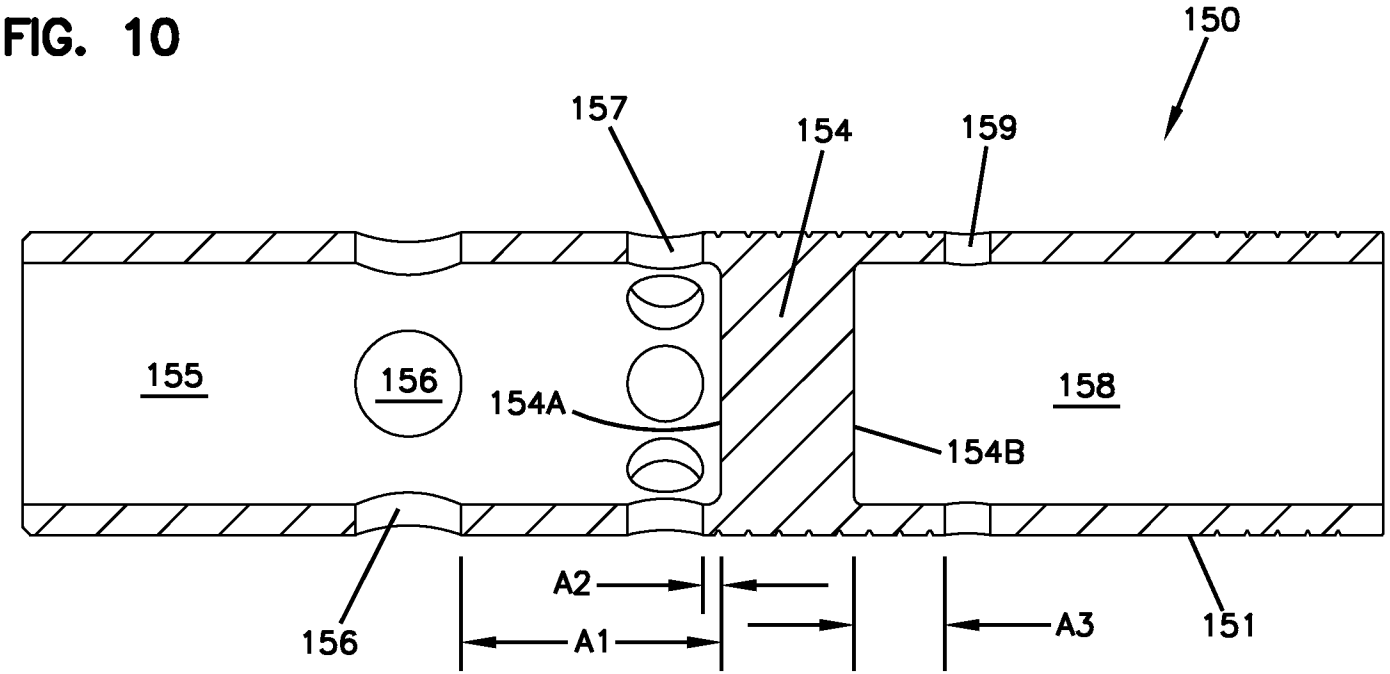
FIG. 10 is a longitudinal cross-section of the pre-compensation spool of FIG. 9.

The compensation valve arrangement 150 has a flow input port 156 and a flow output 157 (see FIGS. 9 and 10). The compensation valve arrangement 150 defaults to the open position (see FIG. 11) in which fluid flows between the input 156 and the output 157. The compensation valve arrangement 150 moves towards the closed position and starts metering the flow when the pressure in the compensator chamber 155 overcomes a combined load from a spring force (e.g., spring 152 of FIG. 7) and a fluid pressure at the first load sense location 124 as will be described in more detail herein. The second load sense location 127 is blocked at the pre-compensation valve arrangement 150.

In accordance with the flow circuit diagram of FIG. 6, fluid flows from the supply line 205, through the load drop check circuit 191, to the supply line input port 211 of the directional valve 130. The directional valve 130 moves between a neutral position, a first working position, and a second working position. In all three positions, the fluid flows from the directional valve 130 to the compensation valve arrangement 150 along the inlet line 122. When the compensation valve arrangement 150 is open, the compensated fluid flows from the compensation valve arrangement 150 to the directional valve 130 along the outlet line 123. As shown in FIG. 6, the fluid does not flow through a restriction (i.e., metering orifice) 217 prior to entering the compensation valve arrangement 150 and flows through the restriction after leaving the compensation valve arrangement 150. Accordingly, the pre-compensation valve arrangement 150 is located upstream of the restriction 217.

The directional valve 130 defaults to a neutral position in which the compensated fluid is not directed to either work port 104 or work port 105. When the directional valve 130 moves to the first working position, the compensated fluid flows from the directional valve 130 to the first work port 104 along the first work line 214 (e.g., along work port passage 114) and fluid from the second work port 105 returns to the directional valve 130 along the second work line 215 or portion thereof (e.g., along the second work port passage 115). When the directional valve 130 moves to the second working position, the compensated fluid flows from the directional valve 130 to the second work port 105 along the second work line 215 (e.g., along the cross-over passage 116 and the second work port passage 116) and fluid from the first work port 104 returns to the directional valve 130 along the first work line 214 or portion thereof. Returned fluid exits the directional valve 130 at outlet 216 and flows to the return line 206.

FIGS. 7-13 illustrate one example pre-compensation assembly 100A configured in accordance with the flow circuit diagram of FIG. 6. The chassis body 101 of the pre-compensation assembly 100A defines a main spool passage 110 and a compensator spool passage 120 as disclosed above. A first type of main spool 130 is configured to slide within the main spool passage 110. Ends of the main spool 130 are accessible from the open ends 112, 113 of the main spool passage 110 to facilitate directed movement of the main spool 130. A first type of compensator spool arrangement 150 is configured to slide within the compensator spool passage 120.

Figure 8:
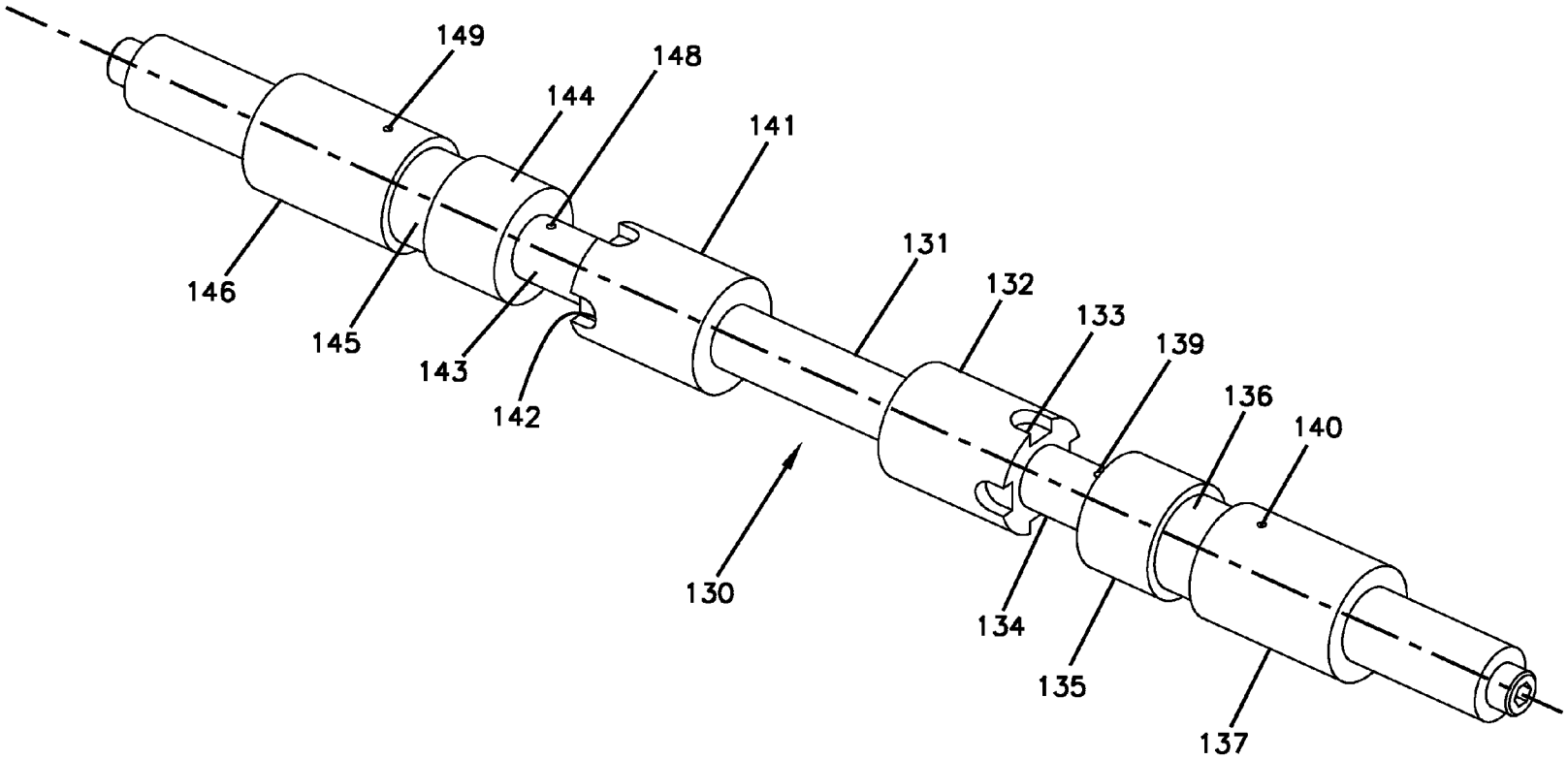
FIG. 8 is an enlarged view of the main spool arrangement of FIG. 7.

FIG. 8 illustrates one example implementation of a main spool 130 suitable for use in a pre-compensation assembly 100A. In general, a right side of the spool 130 is symmetrical with a left side of the spool arrangement. The main spool 130 forms a series of blocking sections (i.e., lands) and recessed sections. For example, the main spool 130 includes a reduced center section 131 that extends between a first right blocking section 132 and a first left blocking section 141. The first blocking sections 132, 141 each define one or more notches 133, 142, respectively, at an opposite side of the respective blocking section 132, 141 from the reduced center section 131. In the example shown, the first blocking sections 132, 141 each define four notches 133, 142 evenly spaced around the circumference of the first blocking sections 132, 141. In other implementations, the notches on each blocking land may be offset from each other by some angle.

Figure 11:
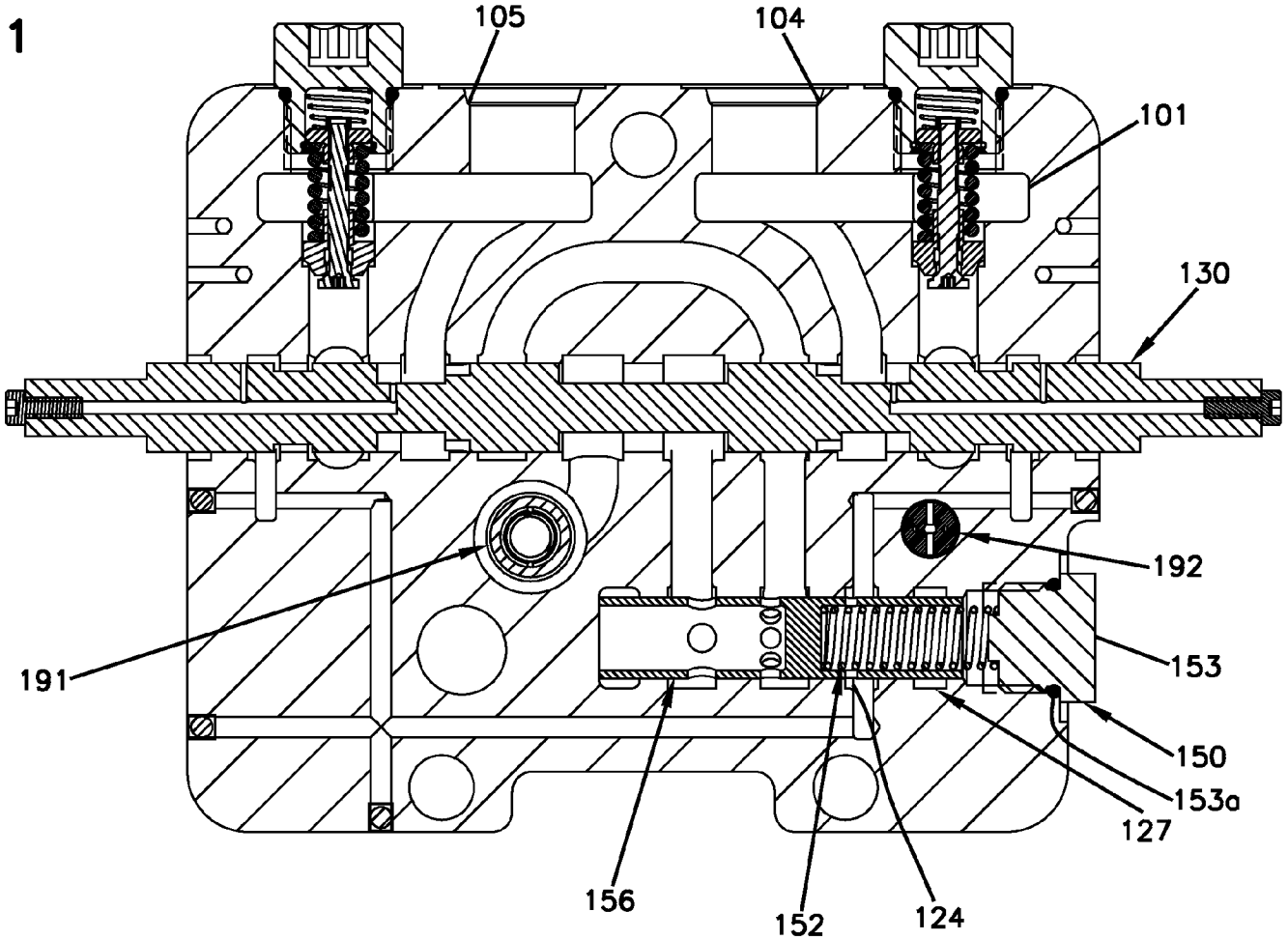
FIG. 11 is a cross-sectional view of the assembled pre-compensation subsection of FIG. 7 with the main spool arrangement disposed in a neutral position.
Figure 12:
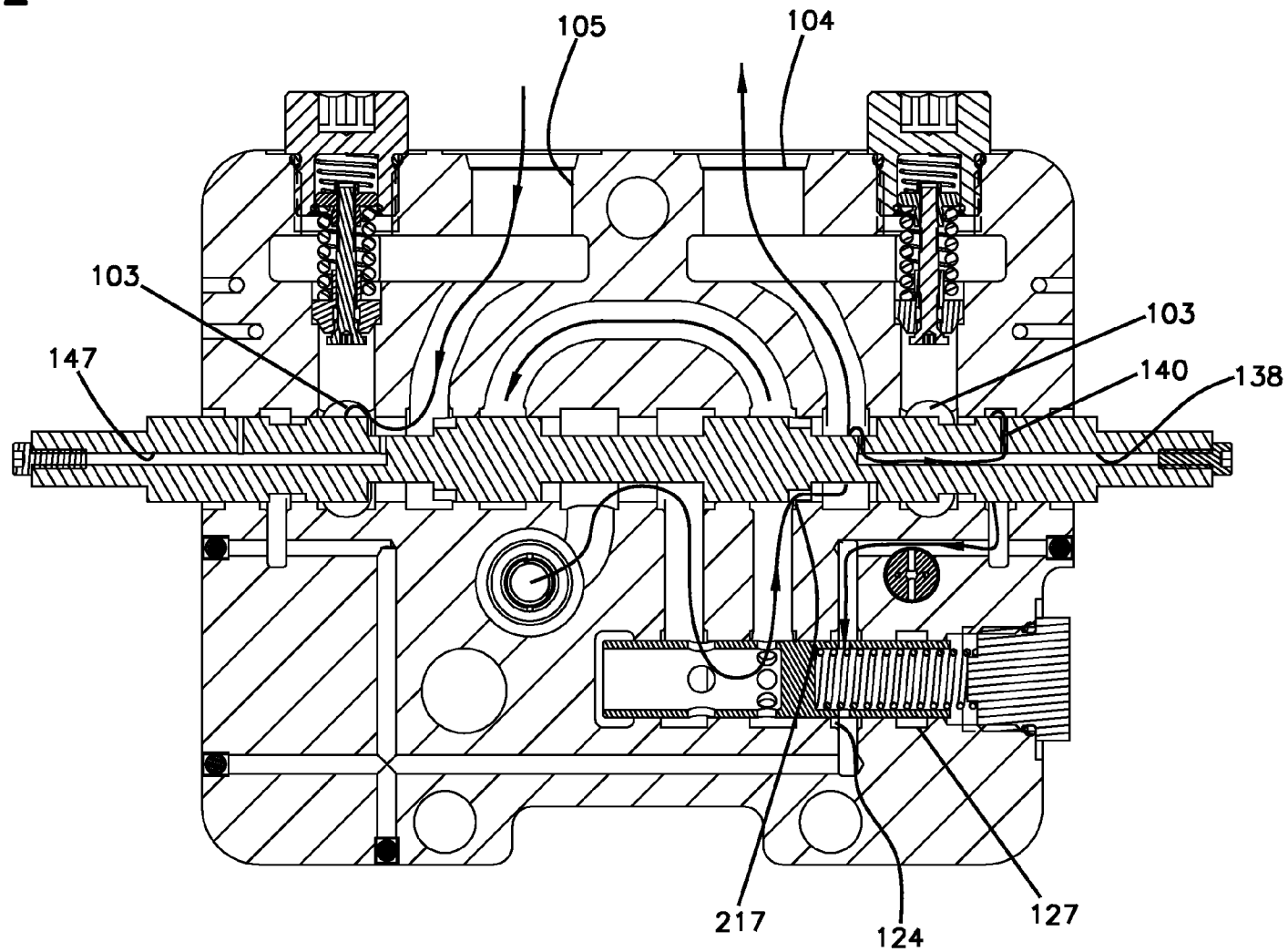
FIG. 12 is a cross-sectional view of the assembled pre-compensation subsection of FIG. 7 with the main spool arrangement disposed in a first working position.
Figure 13:
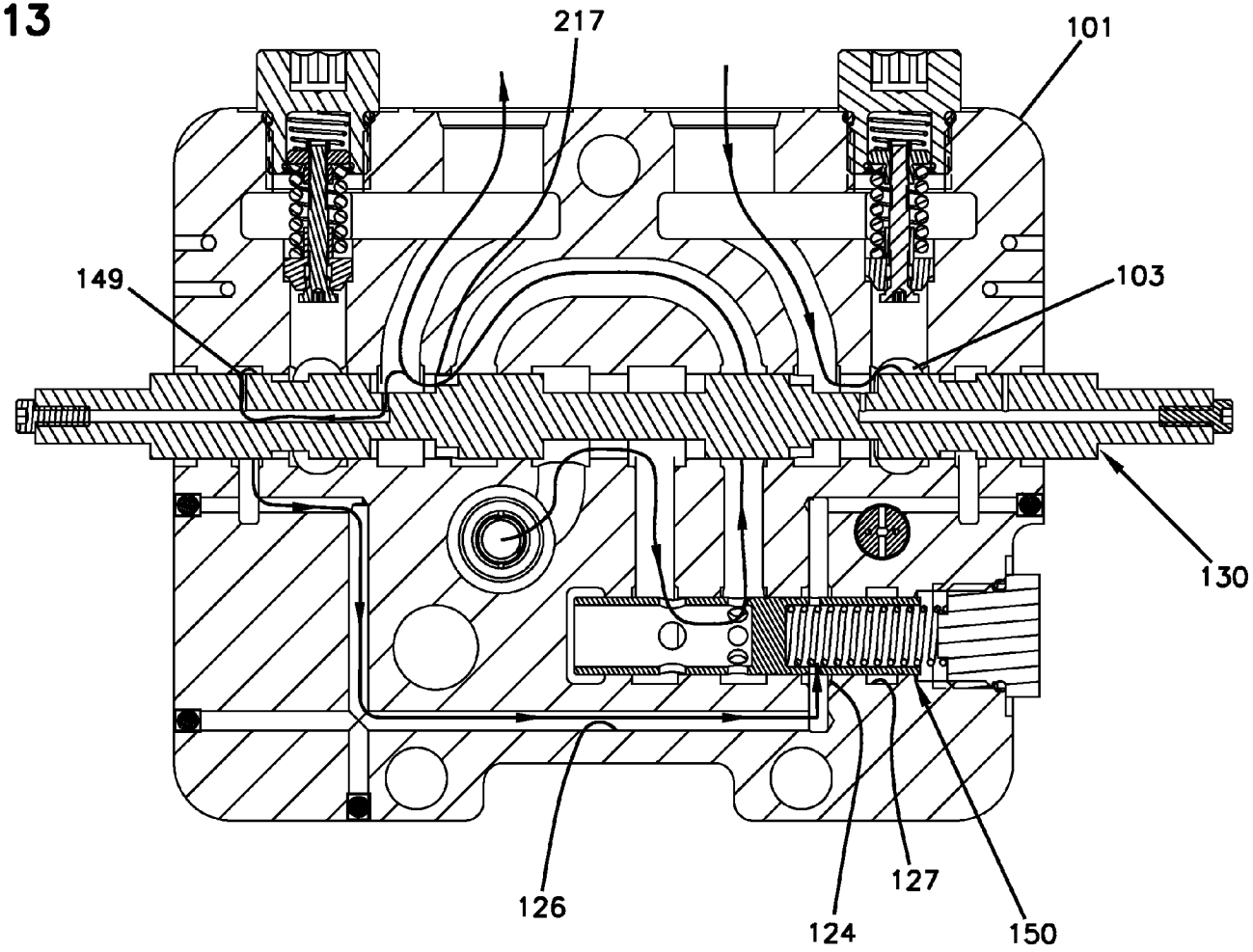
FIG. 13 is a cross-sectional view of the assembled pre-compensation subsection of FIG. 7 with the main spool arrangement disposed in a second working position.

A first right reduced section 134 extends outwardly from the notched side of the first right blocking section 132 to a second right blocking section 135. A second right reduced section 136 extends outwardly from the second right blocking section 135 to a third right blocking section 137. As shown in FIGS. 11-13, a right through-channel 138 extends through the spool along the second right blocking section 135 and the second right reduced section 136. The first right reduced section 134 defines an inlet 139 to the right through-channel 138 and the third right blocking section 137 defines an outlet 140 from the right through-channel 138.

Likewise, a first left reduced section 143 extends outwardly from the notched side of the first left blocking section 141 to a second left blocking section 144. A second left reduced section 145 extends outwardly from the second left blocking section 144 to a third left blocking section 146. As shown in FIGS. 11-13, a left through-channel 147 extends through the spool along the second left blocking section 144 and the second left reduced section 145. The first left reduced section 143 defines an inlet 148 to the left through-channel 147 and the third left blocking section 146 defines an outlet 149 from the left through-channel 147.

As shown in FIG. 7, the compensator spool arrangement 150 includes a compensator spool 151, a spring 152, and a plug 153. FIGS. 9 and 10 illustrate one example implementation of a compensation spool 151 suitable for use in a pre-compensation assembly 100A. The compensation spool 151 defines a first chamber 155 and a second chamber 158 separated by a wall 154. The wall 154 defines a first pilot surface 154A facing into the first chamber 155 and a second pilot surface 154B facing into the second chamber 158. The first chamber 155 defines inlets 156 along the circumference of the spool 151 at a first axial distance $A_1$ from the wall 154. The first chamber 155 also defines outlets 157 along the circumference of the spool 151 at a second distance $A_2$ from the wall 154.

The outlets 157 are axially spaced from inlets 156. In the example shown, the axial distance from the wall 154 of the inlets 156 is greater than the axial distance form the wall 154 of the outlets 157. In certain implementations, the spool 151 defines a greater or fewer numbers of outlets 157 than inlets 156. In the example shown, the spool 151 defines four inlets and eight outlets 157. In other implementations, however, the spool 151 may define greater or fewer inlets 156 and/or outlets 157.

The second chamber 158 is sized and shaped to receive the spring 152 of the compensator spool arrangement 150 (see FIG. 11-13). A gasket (e.g., an O-ring) 153*a* may be disposed on the plug 153 to seal the compensator spool arrangement 150 within the compensation passage 120. The second chamber 158 defines one or more pilot inlets 159. In some implementations, the pilot inlets 159 are disposed around a circumference of the spool 151 at an axial distance $A_3$ from the wall 154. In certain implementations, the pilot inlets 159 are smaller than the inlets 156 to the first chamber 155. Indeed, in certain implementations, the pilot inlets 159 of the second chamber 158 are smaller than the outlets 157 of the first chamber 155. In other implementations, the pilot inlets 159 may be larger than the inlets 156 and/or the outlets 157. In the example shown, the pilot inlets 159 disposed on opposite sides of the circumference of the spool 151.

FIGS. 11-13 are cross-sectional views of the pre-compensation assembly 100A showing the main spool 130 in each of three positions: the neutral position, the first working position, and the second working position, respectively. In the neutral position (FIG. 11), the main spool 130 is disposed in the main spool passage 110 so that the reduced center section 131 (FIG. 8) extends between the pump inlet passage 111 (FIG. 5) and the compensator inlet passage 122 of the chassis body 101. Accordingly, fluid can flow from the load drop check assembly 191 (FIG. 7), through the inlet passage 111, through the compensator inlet passage 122, and into the first chamber 155 of the spool 151 through the inlets 156.

As shown in FIG. 11, the spring 152 of the compensator spool arrangement 150 extends into the second spool chamber 158 to bias the spool 151 towards the closed end of the compensation passage 120. The opposite end of the spring 152 is braced against the plug 153. The plug 153 includes a gasket (e.g., O-ring 153*a*) that seals the compensator spool arrangement 150 within the passage 120 of the chassis body 101. When the spool 151 abuts the closed end of the passage 120, the spool inlets 156 are aligned with the compensation inlet passage 122 (FIG. 5) and the spool outlets 157 are aligned with the compensation outlet passage 123, creating a flow path through the first spool chamber 155. However, the first right blocking section 132 and first left blocking section 141 of the main spool 130 blocks the fluid from leaving the compensator outlet passage 123.

The compensator spool 151 remains in the open position until the pressure in chamber 155 overcomes the pressure of the bias of the spring 152 and a pilot pressure in the second spool chamber 158. The pilot inlets 159 of the second chamber 158 are axially disposed to align with the first load sensing location 124, which provides the pilot pressure to the second spool chamber 158. The pilot inlets 159 do not align with a second load sensing location 127. Rather, the circumferential wall of the second chamber 158 extends across and blocks the second load sensing location 127.

FIG. 12 illustrates the pre-compensation assembly 100A with the main spool 130 disposed in the first working position. In the example shown, the main spool 130 is shifted towards the second side of the chassis body 101. Shifting the main spool 130 axially moves the first right blocking section 132 sufficient to align the notches 133 with the compensator outlet passage 123 to enable the pressure compensated fluid to flow through the notches 133 towards the first right reduced section 134. The notches 133 are sized to form a restricted passage through which the pressure compensated fluid flows, thereby regulating the fluid flow. The first right reduced section 134 is aligned with the first work passage 114 (FIG. 5) leading to the first work port 104. Accordingly, the restricted fluid flows through the first work passage 114 to the first work port 104.

The compensated fluid also may flow into the cross-over passage 116. In some implementations, the cross-over passage 116 connects to the compensator outlet passage 123 along an annular channel or recess (not visible in FIG. 12) that is defined in the chassis body 101 and that extends around the first right blocking section 132. In other implementations, the fluid flows through the notches 133 in the first right blocking section 132. However, the first left blocking section 141 of the main spool 130 blocks the exit of the cross-over passage 116, thereby inhibiting any fluid from flowing to the second work port 105.

The load sense pilot pressure input location 124 receives pressure from the work port 104. As can be seen, the second right blocking section 135 restricts fluid from the work port 104 from flowing to the return line 103. The first right reduced section 134 also defines the inlet 139 to the right through-channel 138. Fluid enters the through-channel 138 through the inlet 139, flows towards the first side of the chassis body 101, and exits the through-channel 138 through the outlet 140. The outlet 140 aligns with the load sense chamber inlet 117 that leads to the first load sense chamber passage 125. Accordingly, the pilot pressure in the second spool chamber 158 of the compensator spool 151 is the pressure of the fluid at the first work port 104.

The first left reduced section 143 of the main spool 130 enables fluid at the second work port 105 to flow through the main spool passage 110 and into a return line outlet 103. While the entrance 148 of the left through-channel is open to the fluid from the second work port 105, the outlet 149 is blocked by the chassis body 101. Accordingly, the fluid from the second work port 105 does not influence the pilot pressure at the second chamber 158 of the compensator spool 151. In the example shown, each of the through-channels 138, 147 is blocked at the ends of the spool 130 (e.g., with a screw, plug, or cap).

Depending on the pressure differential between the pressure in chambers 155 and 158, the inlets 156 of the compensator spool 151 opens or closes partially thereby maintaining the required amount of flow. Accordingly, as the fluid flow increases through the spool chamber 155, the pressure at the spool outlets 158 overcomes the bias force of the spring 152 and the fluid pressure from the first load sensing location 124 and the spool 151 is shifted towards the open end 121 of the compensation passage 120. As the spool 151 shifts, the spool inlets 156 are moved at least partially out of alignment with the compensation inlet passage 122, thereby reducing or preventing fluid flow through the pre-compensator 150.

FIG. 13 illustrates the pre-compensation assembly 100A with the main spool 130 disposed in the second working position. In the example shown, the main spool 130 is shifted towards the first side of the chassis body 101. Shifting the main spool 130 axially moves the first right blocking section 132 to block the first work passage 114 (FIG. 5) from the main spool passage 110. Accordingly, none of the compensated fluid flows to the first work port 104. As noted above, the compensated fluid flows into the cross-over passage 116. For example, the cross-over passage 116 connects to the compensator outlet passage 123 along a channel or recess (not visible in FIG. 13) that extends around a circumference of the first right blocking section 132.

Shifting the main spool 130 axially moves the first the first left blocking section 141 sufficient to align the notches 142 with the exit of the cross-over passage 116 to enable the pressure compensated fluid to flow through the notches 142 towards the first left reduced section 143. The notches 142 are sized to form a restricted passage through which the pressure compensated fluid flows, thereby regulating fluid flow. The first left reduced section 143 is aligned with the second work passage 115 leading to the second work port 105. Accordingly, the restricted fluid flows through the second work passage 115 to the second work port 105.

The load sense pilot pressure input location 124 receives fluid pressure from the second work port 105. As can be seen, the second left blocking section 144 blocks the compensated and restricted fluid from flowing to the return line 103. The first left reduced section 143 also defines the inlet 148 to the left through-channel 147. Fluid enters the through-channel 147 through the inlet 148, flows towards the second side of the chassis body 101, and exits the through-channel 147 through the outlet 149. The outlet 149 aligns with the load sense chamber inlet 118 that leads to the second load sense chamber passage 126. Accordingly, the pilot pressure in the second spool chamber 158 of the compensator spool 151 is the pressure of the fluid at the second work port 105.

The first right reduced section 134 of the main spool 130 enables fluid at the first work port 104 to flow through the main spool passage 110 and into a return line outlet 103. While the entrance 139 of the right through-channel 138 is open to the fluid from the first work port 104, the outlet 140 is blocked by the chassis body 101. Accordingly, the fluid from the first work port 104 does not influence the pilot pressure at the second chamber 158 of the compensator spool 151.

Figure 14:
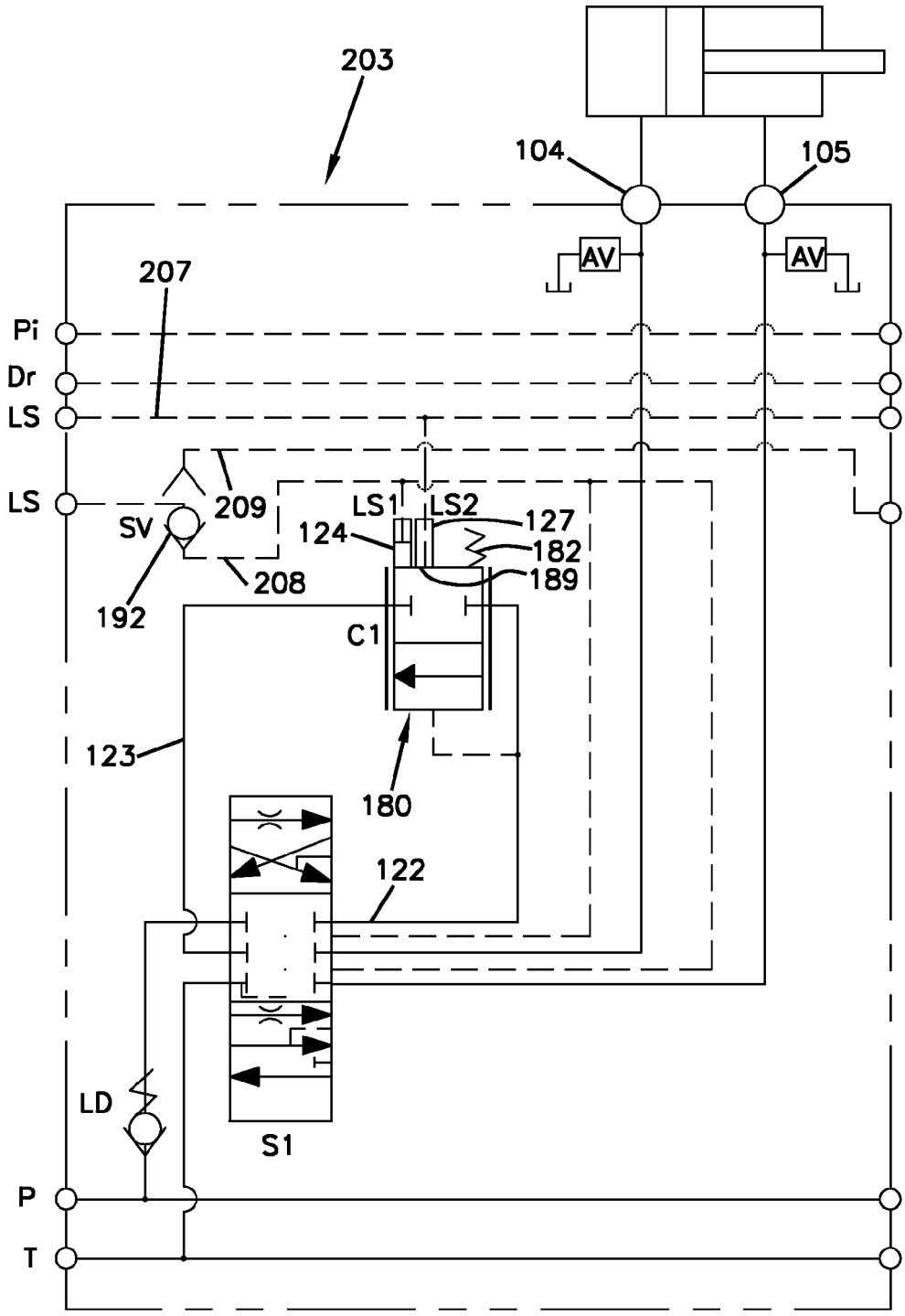
FIG. 14 is a flow circuit diagram of an example post-compensation valve assembly in accordance with the principles of the disclosure.

FIG. 14 is a flow circuit diagram showing the fluid pathways of an example post-compensation subsection 203 of a hydraulic system. The post-compensation circuit includes the same supply line 205, return line 206, and load sense line 207 of the hydraulic valve system 200. The post-compensation circuit 203 also includes a directional valve arrangement 160 and a compensation valve arrangement 180. The directional valve arrangement 160 has three variable positions, each position corresponding to a different flow path arrangement. In some implementation the direction control valve can have more or less then three positions. The compensation valve arrangement 180 has two variable positions—open and closed.

The load sense line 207 connects to a pilot input 189 of the compensation valve arrangement 180 at a second load sense location 127. The load sense line 207 is configured to receive the highest pressure (i.e., greatest load) of all of the work ports out of all of the compensation sub-sections of the hydraulic system. As noted above, the shuttle valve 192 of each subsection receives the work port pressure line 208 and the bypass line 209 and outputs the greater of the two to the subsequent shuttle valve 192. The final shuttle valve 192 outputs into the load sense line 207 for the system. As indicated above, the work port pressure line 208 does not connect to the post-compensation valve arrangement 180.

The directional valve arrangement 160 has a supply line input port 211 that connects to the supply line 205 (e.g., via inlet passage 111 of FIG. 5) and a return line outlet 216 that connects to the return line 206 (e.g., via return line outlets 103). In certain implementations, a load drop check circuit 191 is disposed upstream of the supply line input port 211. The directional valve arrangement 160 also connects to the compensation valve arrangement 180 via the compensation inlet line 122 and the compensation outlet line 123. The directional valve arrangement 160 also connects to the work ports 104, 105. In the example shown, the directional valve arrangement 160 connects to a first work port 104 via a first work line 214 (e.g., work port passage 114 of FIG. 5) and to a second work port 105 via a second work line 215 (e.g., cross-over passage 116 and second work port passage 115 of FIG. 5). In other implementations, the directional valve arrangement 160 may connect to more than two work ports.

Figure 17:
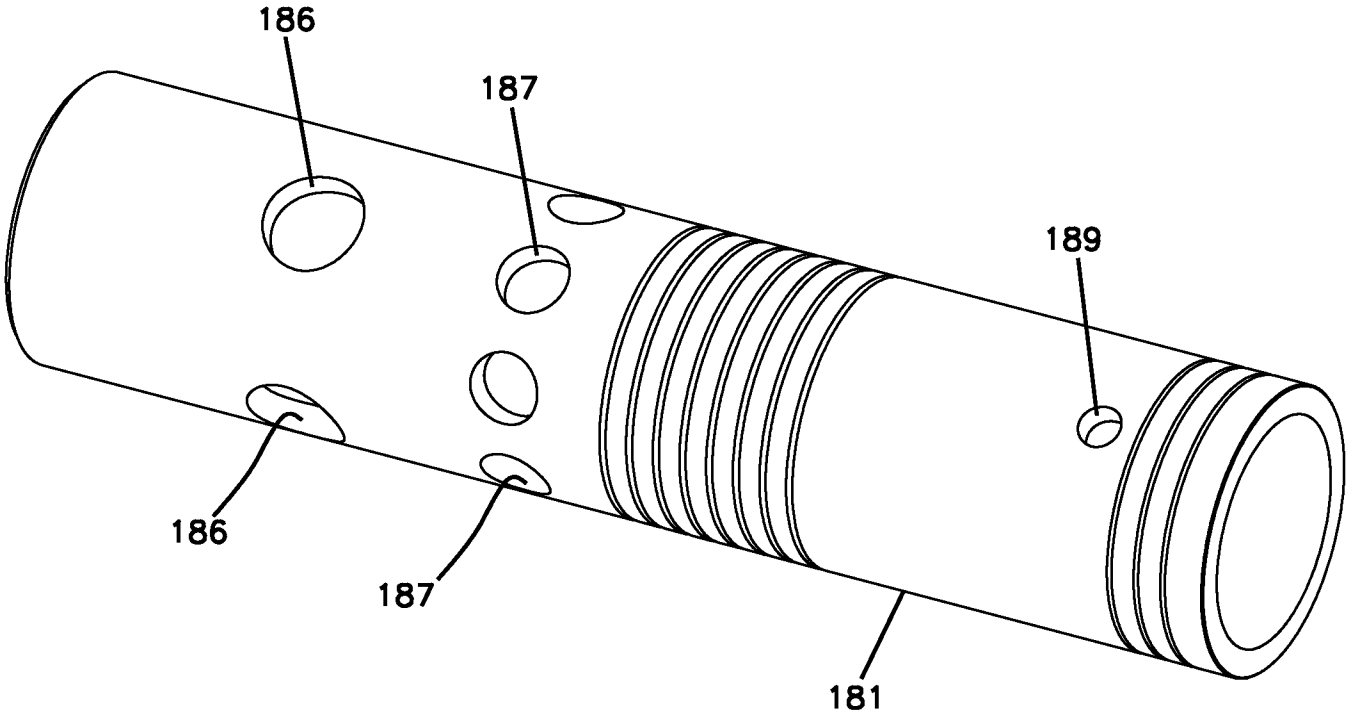
FIG. 17 is an enlarged view of the post-compensation spool of FIG. 15.
Figure 18:
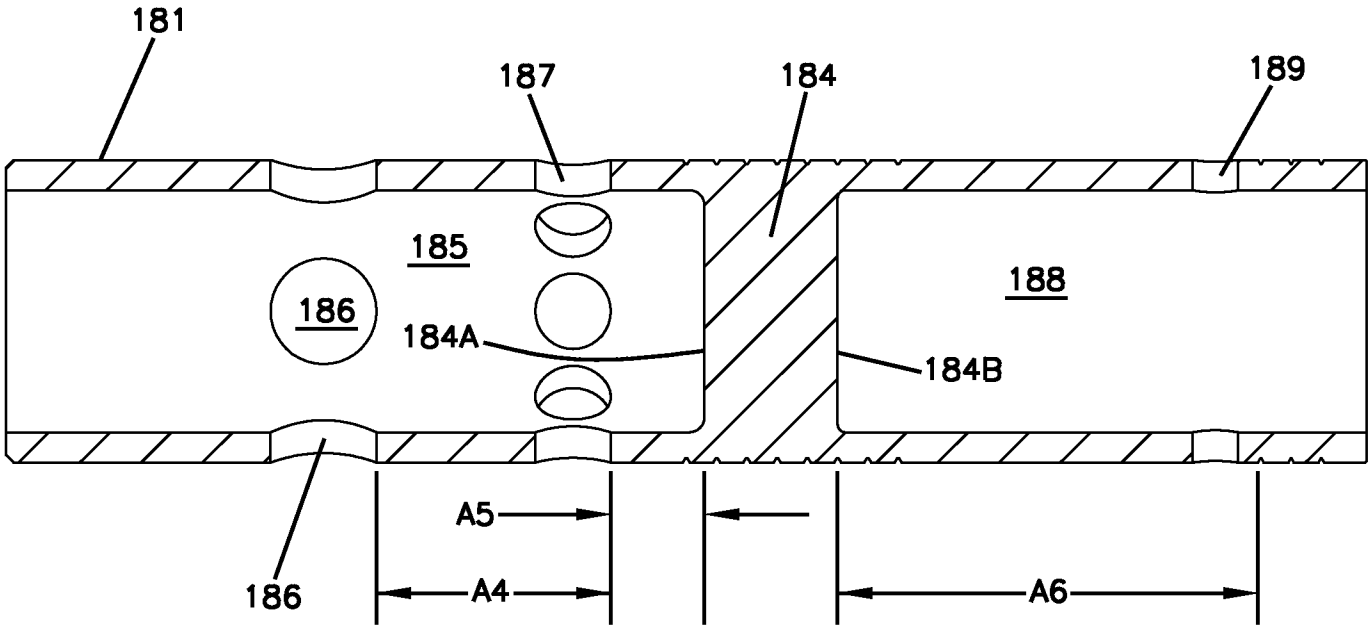
FIG. 18 is a longitudinal cross-section of the post-compensation spool of FIG. 17.

The compensation valve arrangement 180 has a flow input port 186 and a flow output port 187 (see FIGS. 17 and 18). The compensation valve arrangement 180 defaults to the closed position (FIG. 19) in which fluid does not flow between the input port 186 and the output port 187. The compensation valve arrangement 180 moves towards the open position and starts metering the flow when the pressure in the compensator chamber 185 overcomes a combined load from a spring force (e.g., spring 182 of FIG. 15) and a fluid pressure at the second load sense location 127. The first load sense location 124 is blocked at the post-compensation valve arrangement 180.

In accordance with the flow circuit diagram of FIG. 14, fluid flows from the supply line 205, through the load drop check circuit 191, to the supply line input port 211 of the directional valve arrangement 160. The directional valve arrangement 160 moves between a neutral position, a first working position, and a second working position. The directional valve arrangement 160 defaults to a neutral position in which fluid does not flow to the compensation valve arrangement 180. Accordingly, no fluid is directed to the work ports 104, 105. In certain implementations, the directional valve arrangement 160 also does not connect any of the work ports 104, 105 to the return line 206 when in the neutral position. In other implementations, however, the direction control valve may connect one or both work ports 104, 105 to the return line 206 when in the neutral position.

When the directional valve arrangement 160 moves to either of the first and second working positions, the fluid flows from the directional valve arrangement 160 to the input 186 of the compensation valve arrangement 180. When the compensation valve arrangement 180 is opened as described above, the compensated fluid flows from the output 187 of the compensation valve arrangement 180 back to the directional valve arrangement 160. A shown in FIG. 14, the fluid flows through a restriction (i.e., metering orifice) 217' prior to reaching the inlet 186 of the compensation valve arrangement 180. Accordingly, the post-compensation valve arrangement 180 is located downstream of the restriction 217'.

When the directional valve arrangement 160 is in the first working position (FIG. 20), the restricted and compensated fluid flows from the directional valve arrangement 160 to the first work port 104 along the first work line 214 (e.g., along work port passage 114) and fluid from the second work port 105 returns to the directional valve arrangement 160 along the second work line 215 or portion thereof (e.g., the second work port passage 115). When the directional valve arrangement 160 is in the second working position (FIG. 21), the restricted and compensated fluid flows from the directional valve arrangement 160 to the second work port 105 along the second work line 215 (e.g., cross-over passage 116 and the second work port passage 115) and fluid from the first work port 104 returns to the directional valve arrangement 160 along the first work line 214 or portion thereof. Returned fluid exits the directional valve arrangement 160 at outlet 216 and flows to the return line 206.

FIGS. 15-21 illustrate another example post-compensation assembly configured in accordance with the flow circuit diagram of FIG. 14. FIGS. 15-21 illustrate one example post-compensation assembly 100B configured in accordance with the flow circuit diagram of FIG. 14. The chassis body 101 of the post-compensation assembly 100B defines a main spool passage 110 and a compensator spool passage 120 as disclosed above. A second type of main spool arrangement 160 is configured to slide within the main spool passage 110. Ends of the main spool arrangement 160 are accessible from the open ends 112, 113 of the main spool passage 110 to facilitate directed movement of the main spool arrangement 160. A second type of compensator spool arrangement 180 is configured to slide within the compensator spool passage 120.

Figure 16:
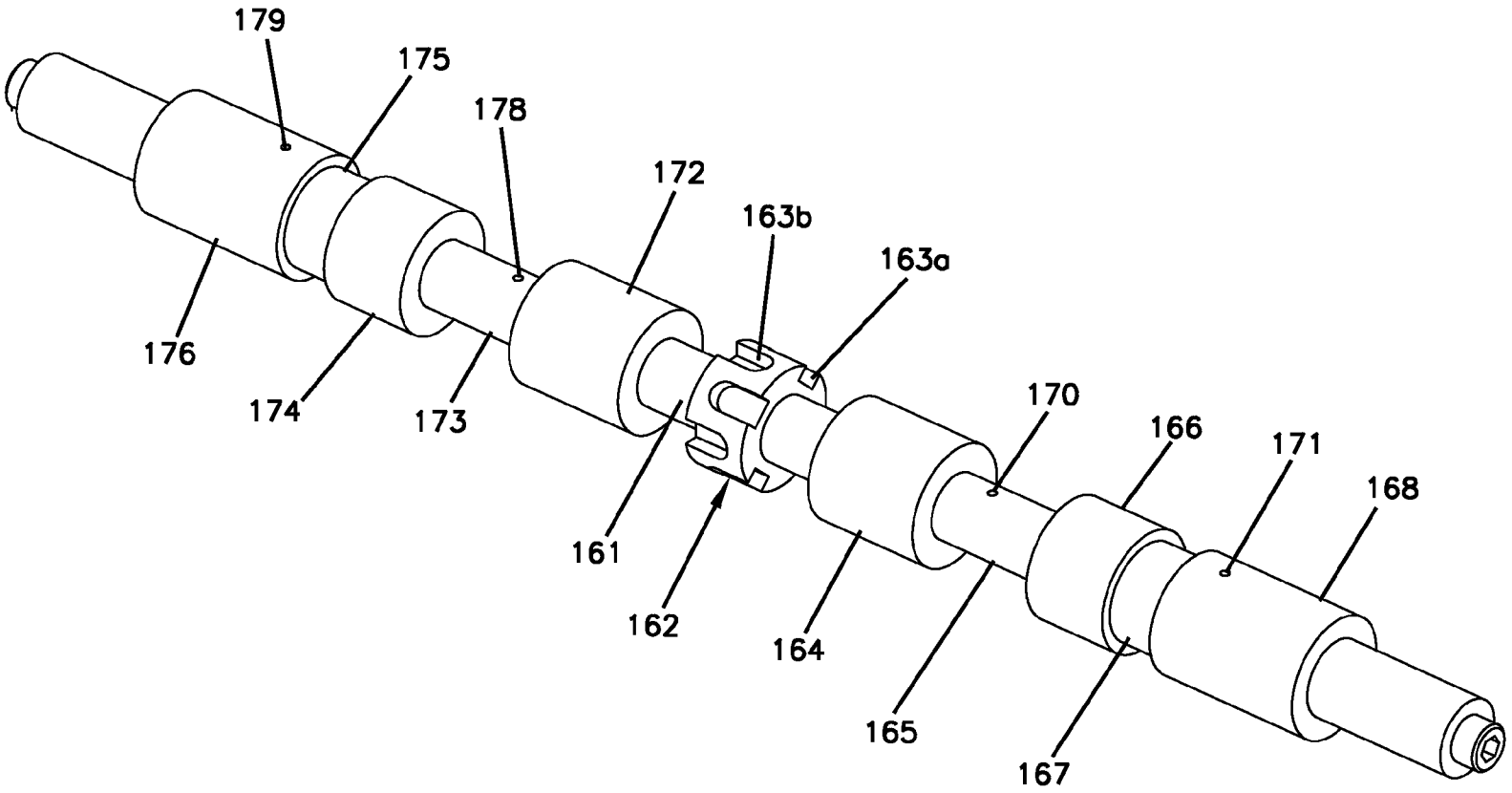
FIG. 16 is an enlarged view of the main spool arrangement of FIG. 15.

FIG. 16 illustrates one example implementation of a main spool arrangement 160 suitable for use in a post-compensation assembly 100B. A right side of the spool arrangement 160 is mostly symmetrical with a left side of the spool arrangement. The main spool arrangement 160 includes a reduced center section 161 that extends between a first right blocking section 164 and a first left blocking section 172. A center metering section 162 is disposed at an intermediate point along the central reduced section 161.

The center metering section 162 defines a first set of notches 163*a* opening towards the right side and a second set of notches 163*b* opening towards the left side. In the example shown, the center metering section 162 defines four right notches 163*a* spaced in between four left notches 163*b*. In other implementations, however, the center metering section 162 may define a greater or fewer number of notches 163*a*, 163*b*. In certain implementations, the center metering section 162 may define notches 163*a*, 163*b* of varying size. In certain implementations, each set of notches 163*a*, 163*b* extends along a majority of an axial length of the center metering section 162.

Figure 19:
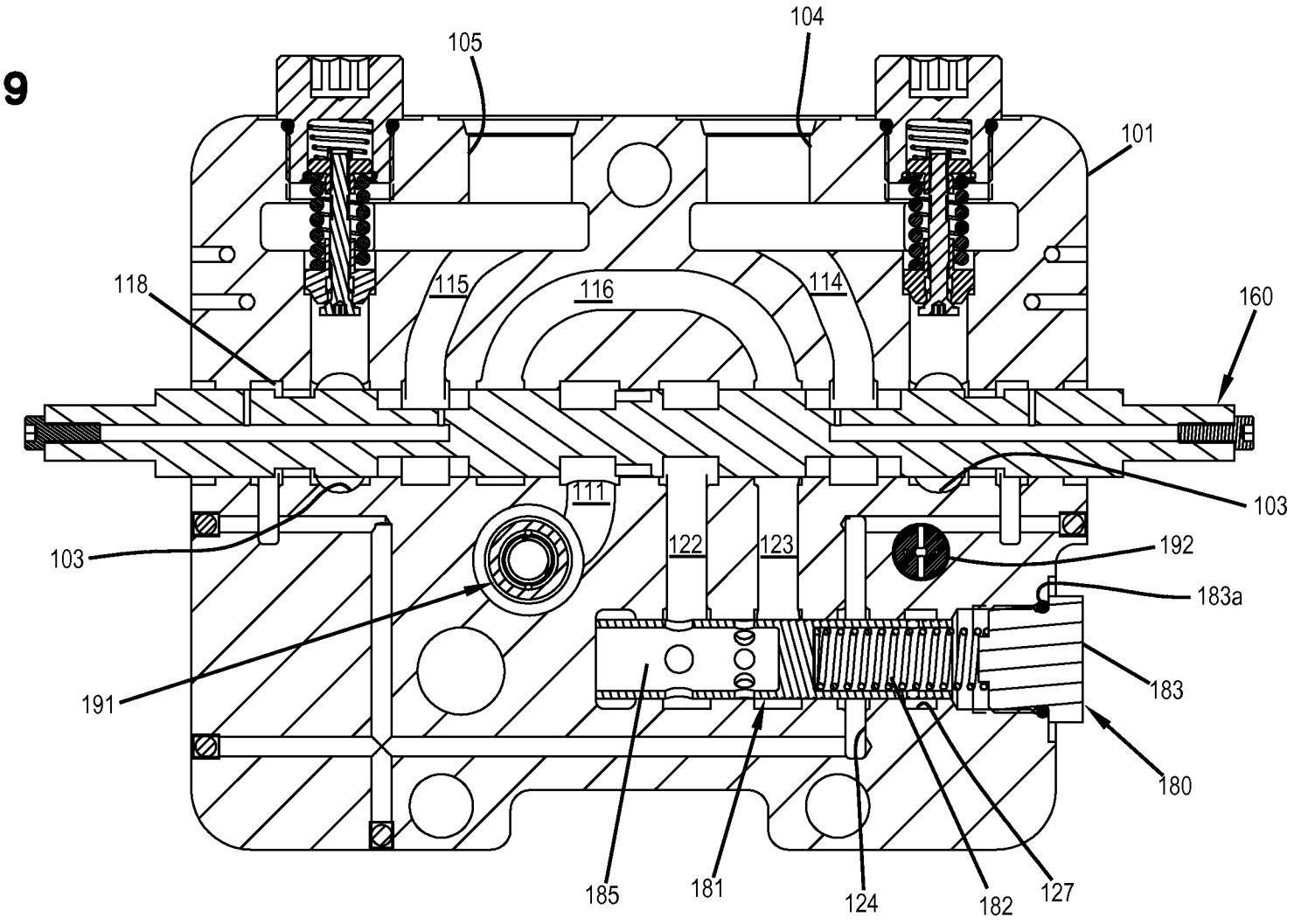
FIG. 19 is a cross-sectional view of the assembled post-compensation subsection of FIG. 15 with the main spool arrangement disposed in a neutral position.
Figure 20:
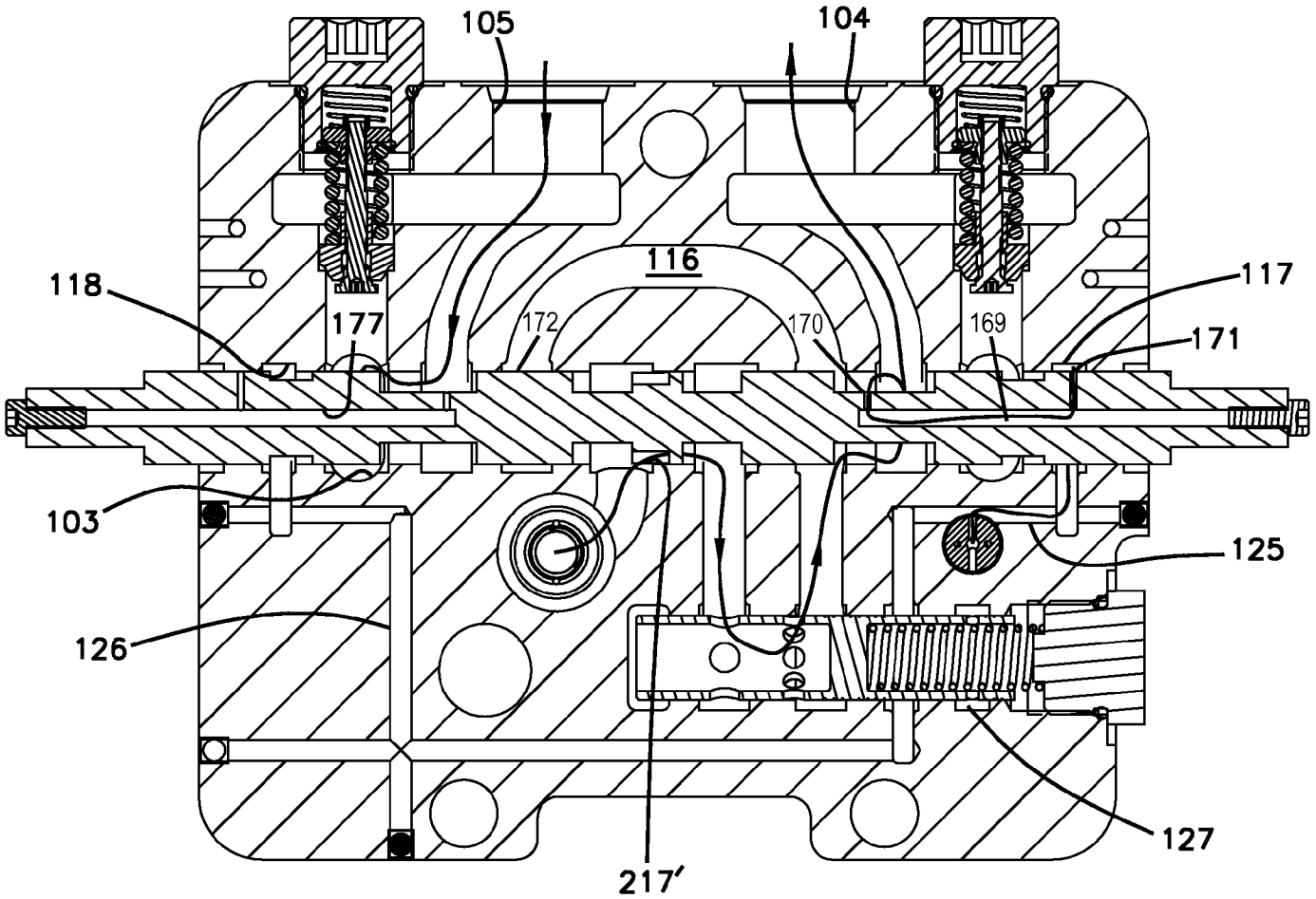
FIG. 20 is a cross-sectional view of the assembled post-compensation subsection of FIG. 15 with the main spool arrangement disposed in a first working position.
Figure 21:
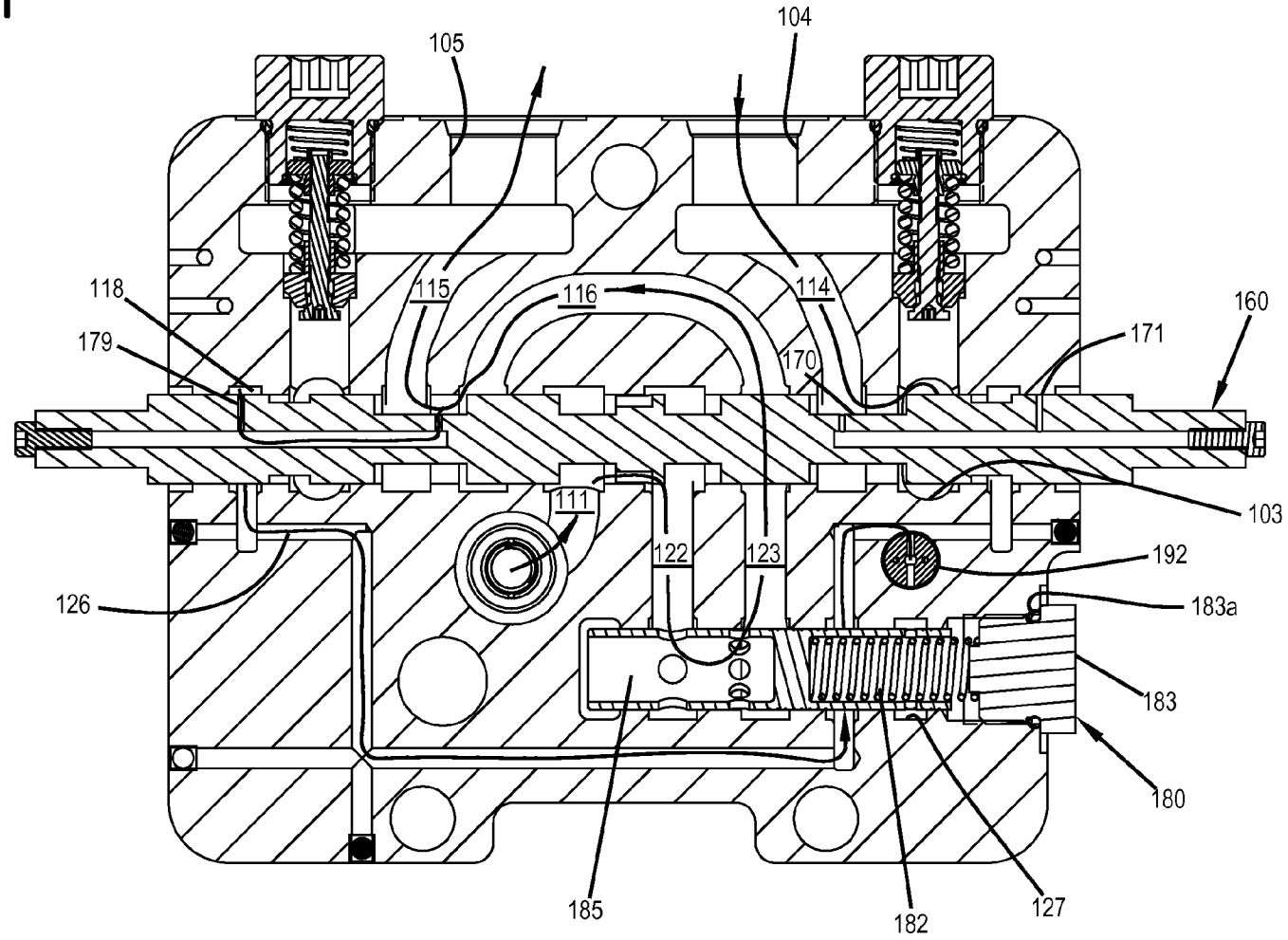
FIG. 21 is a cross-sectional view of the assembled post-compensation subsection of FIG. 15 with the main spool arrangement disposed in a second working position.

A first right reduced section 165 extends outwardly from the first right blocking section 164 to a second right blocking section 166. A second right reduced section 167 extends outwardly from the second right blocking section 166 to a third right blocking section 168. As shown in FIGS. 19-21, a right through-channel 169 extends through the spool 160 along the second right blocking section 166 and the second right reduced section 167. The first right reduced section 165 defines an inlet 170 to the right through-channel 169 and the third right blocking section 168 defines an outlet 171 from the right through-channel 169.

Likewise, a first left reduced section 173 extends outwardly from the first left blocking section 172 to a second left blocking section 174. A second left reduced section 175 extends outwardly from the second left blocking section 174 to a third left blocking section 176. As shown in FIGS. 19-21, a left through-channel 177 extends through the spool 160 along the second left blocking section 174 and the second left reduced section 175. The first left reduced section 173 defines an inlet 178 to the left through-channel 177 and the third left blocking section 176 defines an outlet 179 from the left through-channel 177.

Figure 15:
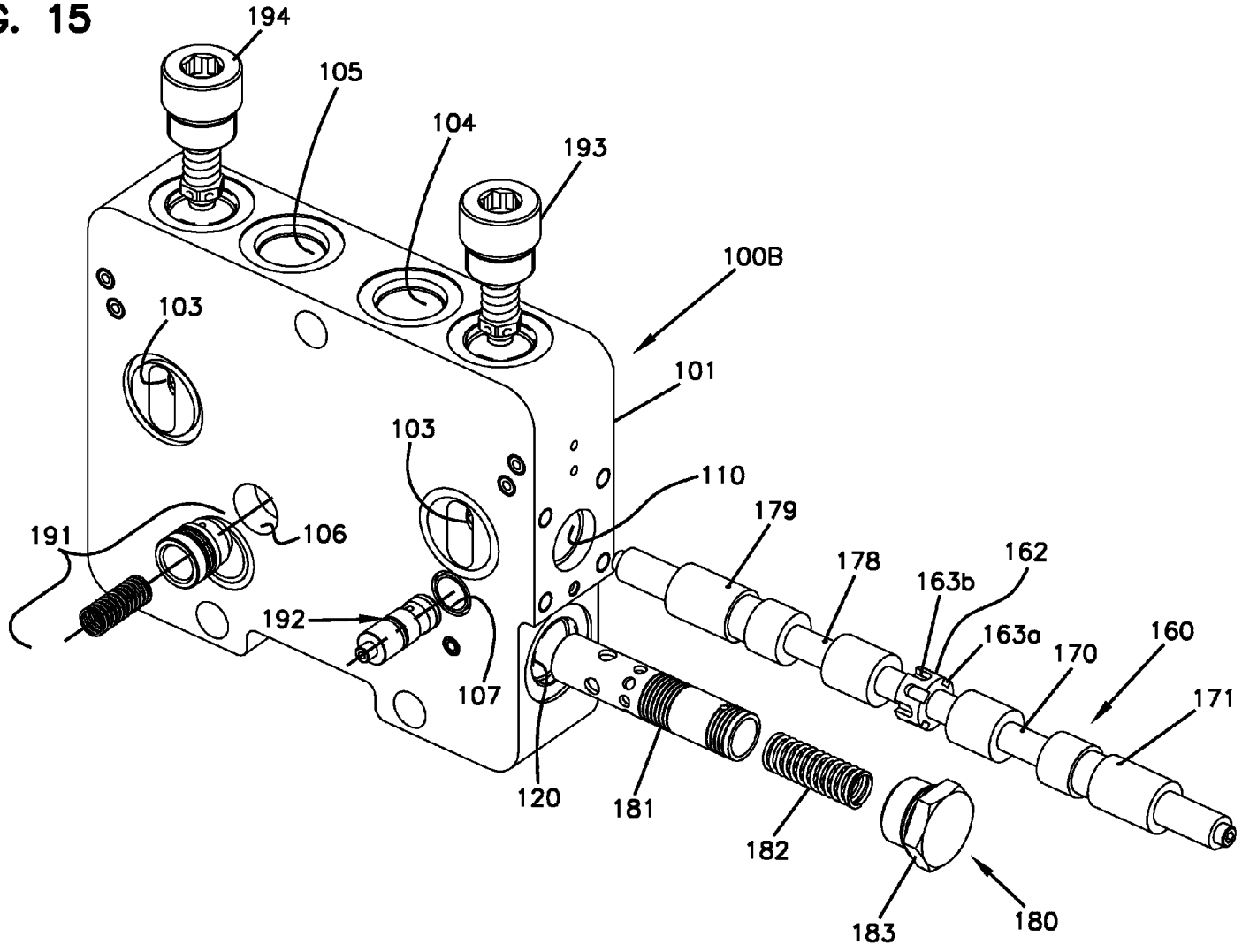
FIG. 15 is a perspective view of an example post-compensation subsection of an example hydraulic system having the post-compensation spool arrangement and the main spool arrangement exploded from the chassis body along with the load drop check assembly, the shuttle valve, and the shock valves.

As shown in FIG. 15, the compensator spool arrangement 180 includes a compensator spool 181, a spring 182, and a plug 183. FIGS. 17 and 18 illustrate one example implementation of a compensation spool 181 suitable for use in a post-compensation assembly 100B. The compensation spool 181 defines a first chamber 185 and a second chamber 188 separated by a wall 184. The wall 184 defines a first pilot surface 184A facing into the first chamber 185 and a second pilot surface 184B facing into the second chamber 188. The first chamber 185 defines inlets 186 along the circumference of the spool 181 at a first axial distance $A_4$ from the wall 184. The first chamber 185 also defines outlets 187 along the circumference of the spool 181 at a second distance $A_5$ from the wall 184.

The outlets 187 are axially spaced from inlets 186. In the example shown, the axial distance from the wall 184 of the inlets 186 is greater than the axial distance form the wall 184 of the outlets 187. In certain implementations, the spool 181 defines a greater or fewer numbers of outlets 187 than inlets 186. In the example shown, the spool 181 defines four inlets 186 and eight outlets 187. In other implementations, however, the spool 181 may define greater or fewer inlets 186 and/or outlets 187.

In some implementations, the axial distance A5 between the outlets 187 and the wall 184 of the post-compensation spool arrangement 180 is larger than the axial distance A2 between the outlets 157 and the wall 154 of the pre-compensation spool arrangement 150 of FIGS. 9 and 10. In some implementations, the axial distance A4 between the inlets 186 and the wall 184 of the post-compensation spool arrangement 180 is larger than the axial distance A1 between the inlets 156 and the wall 154 of the pre-compensation spool arrangement 150 of FIGS. 9 and 10. In certain implementations, the distance between the spool outlets 187 and the spool inlets 186 of the post-compensation spool 181 is about the same as the distance between the distance between the spool outlets 157 and the spool inlets 156 of the pre-compensation spool 151.

The second chamber 188 is sized and shaped to receive the spring 182 of the compensator spool arrangement 180 (see FIG. 19-21). A gasket (e.g., an O-ring) 183*a* may be disposed on the plug 183 to seal the compensator spool arrangement 180 within the compensation passage 120. The second chamber 188 defines one or more pilot inlets 189. In some implementations, the pilot inlets 189 are disposed around a circumference of the spool 181 at an axial distance $A_6$ from the wall 184. In certain implementations, the pilot inlets 189 are smaller than the inlets 186 to the first chamber 185. Indeed, in certain implementations, the pilot inlets 189 of the second chamber 188 are smaller than the outlets 187 of the first chamber 185. In the example shown, the pilot inlets 189 disposed on opposite sides of the circumference of the spool 181.

In some implementations, the axial distance A6 between the pilot inlets 189 and the wall 184 of the post-compensation spool arrangement 180 is larger than the axial distance A2 between the pilot inlets 159 and the wall 154 of the pre-compensation spool arrangement 150 of FIGS. 9 and 10. For example, in certain implementations, the pilot inlets 189 of the post-compensation spool arrangement 180 are located closer to the open end of the second chamber 188 then to the wall 184. In contrast, the pilot inlets 159 of the pre-compensation spool arrangement 150 are located closer to the wall 154 then to the open end of the second chamber 158.

In general, the compensation spool inlets 156, 159, 186, 189 and outlets 157, 187 are each positioned relative to the respective wall 154, 184 of the spool 151, 181. The location of the wall 154, 184 relative to the rest of the compensation spool 151, 181 may differ between various embodiments of the spool 151, 181 to accommodate different embodiments of other components (e.g., to accommodate springs 152, 182 of various sizes). Accordingly, the locations of the inlets and outlets of the compensation spools may differ between the various embodiments.

FIGS. 19-21 are cross-sectional views of the post-compensation assembly 100B showing the main spool arrangement 160 in each of three positions: the neutral position, the first working position, and the second working position, respectively. In the neutral position, the main spool arrangement 160 is disposed in the main spool passage 110 so that the reduced center section 161 extends between the pump inlet passage 111 and the compensator inlet passage 122 of the chassis body 101. The metering section 162 is disposed between the pump inlet passage 111 and the compensator inlet passage 122. The compensator arrangement 180 is disposed in the closed position.

Accordingly, fluid can flow from the load drop check assembly 191, through the inlet passage 111, to the metering section 162 of the main spool 160. The metering section 162 is disposed so that fluid cannot flow over either side of notches 163*a*, 163*b* to the compensation inlet passage 122. Accordingly, fluid does not flow to the post-compensator arrangement 180. Further, even if some fluid managed to bypass the metering section 162 and passed through the compensator spool 181, the first right blocking section 164 inhibits passage of the fluid to the first work passage 114 and the first left blocking passage 172 inhibits passage of the fluid from the cross-over passage 116 to the second work passage 115.

As shown in FIG. 19, the spring 182 of the post-compensator spool arrangement 180 extends from the plug 183 into the second spool chamber 188 to bias the spool 181 towards the closed end of the compensation passage 120. When the spring 182 biases the spool 181 sufficiently towards the closed end, the compensator spool outlets 187 do not align with the compensator outlet passage 123 and the spool 181 is closed. The compensator spool 181 remains in the closed position until the pressure in chamber 185 overcomes the bias of the spring 182 and a pilot pressure in the second spool chamber 188. The pilot inlets 189 of the second chamber 188 are axially disposed to align with the second load sensing location 127, which provides the pilot pressure to the second spool chamber 188 as will be disclosed in more detail herein. The pilot inlets 189 do not align with the first load sensing location 124. In fact, the circumferential wall of the second chamber 188 extends across and blocks the first load sensing location 124.

FIG. 20 illustrates the post-compensation assembly 100B with the main spool arrangement 160 disposed in the first working position. In the example shown, the main spool arrangement 160 is shifted towards the second side of the chassis body 101. Shifting the main spool 160 axially moves the metering section 162 sufficient so that the left sides of the right notches 163*a* enter a portion of the inlet passage 111. When the right notches 163*a* extend into the inlet passage 111, fluid may flow over the right notches 163*a*. Each of the notches 163*a* is sized to form a restricted passage through which the uncompensated fluid may flow, thereby creating a pressure drop. The first left blocking section 172 inhibits fluid from flowing into the second work passage 115.

The reduced center section 161 of the main spool 160 directs the restricted fluid into the compensator inlet passage 122. When sufficient fluid enters the spool 181 through the inlets 186 at the inlet passage 122, the pressure within the first spool chamber 185 will overcome the bias of the spring 182 and the pilot pressure in the second spool chamber 188, thereby shifting the spool 181 towards the open end 121 of the compensator passage 120. As noted above, the pilot pressure in the second spool chamber 188 of the post-compensator arrangement 180 is provided by the second load sense chamber 127 of the chassis body 101, which is connected to the load sense line (e.g., load sense line 207 of FIGS. 3, 6, and 14) of the hydraulic system.

By shifting the spool 181 towards the open end 121, the outlets 187 of the first spool passage 185 start to open into the passage 123 of the chassis body 101. The compensation outlet passage 123 with at least a portion of first right reduced section 165 of the main spool 160, which is aligned with the first work passage 114 leading to the first work port 104. The compensated, restricted fluid flows from the compensation outlet passage 123, over the first right reduced section 165, and into the first work passage 114 to the first work port 104. As can be seen, the second right blocking section 166 blocks the compensated and restricted fluid from flowing to the return line 103. In certain implementations, the compensated, restricted fluid also may flow into the cross-over passage 116, but is stopped at the first left blocking section 172 of the main spool 160.

The main spool 160 is configured to direct some restricted fluid to the shuttle valve 192 to determine whether the first work port 104 has the higher load than the highest load received along the load sense line (load sense line 207 of FIGS. 3, 6, and 14) from the previous sub-sections. The first right reduced section 165 defines the inlet 170 to the right through-channel 169. Fluid enters the through-channel 169 through the inlet 170, flows towards the first side of the chassis body 101, and exits the through-channel 169 through the outlet 171. The outlet 171 aligns with the load sense chamber inlet 117 that leads to the first load sense chamber passage 125, which connects to the shuttle valve 192.

The shuttle valve 192 also receives an input from the load sense line received from previous sub-sections of the hydraulic system. If the load of the work port fluid (i.e., from work port 104) is more than the input load from the load sense line, then the shuttle valve 192 passes the load of the work port fluid on to the next sub-section via the load sense line. If the load of the work port fluid is less than the input load from the load sense line, however, then the shuttle valve 192 passes on the signal from the load sense line. Accordingly, the pressure received from the load sense line at the second load sense pilot pressure input location 127 is the highest pressure input to the load sense line from any of the post-compensation sub-sections.

The first left reduced section 173 of the main spool 130 enables fluid at the second work port 105 to flow through the working passage 115, through the main spool passage 110, and into a return line outlet 103. While the entrance 178 of the left through-channel 177 is open to the fluid from the second work port 105, the outlet 179 is blocked by chassis body 101. Accordingly, the fluid from the second work port 105 is not passed to the shuttle valve 192 and does not influence the pilot pressure at the second load sense pilot pressure input location 127. In the example shown, each of the through-channels 169, 177 is blocked at the ends of the spool 160 (e.g., with a screw, plug, or cap). Depending on the pressure differential between the pressure in chambers 185 and 188, the outlets 187 of the compensator spool 181 opens or closes partially thereby maintaining the required amount of flow.

FIG. 21 illustrates the post-compensation assembly 100B with the main spool arrangement 160 disposed in the second working position. In the example shown, the main spool arrangement 160 is shifted towards the first side of the chassis body 101. Shifting the main spool 160 axially moves the metering section 162 sufficient so that the right sides of the left notches 163*b* enter a portion of the compensation inlet passage 122. When the left notches 163*b* extend into the compensation inlet passage 122, fluid may flow over the left notches 163*b*. Each of the notches 163*b* is sized to form a restricted passage through which the uncompensated fluid may flow, thereby creating a pressure drop. The first right blocking section 164 inhibits fluid from flowing into the first work passage 114, the return outlet 103, or the cross-over passage 116 from the left notches 163*b*.

The reduced center section 161 of the main spool 160 directs the restricted fluid into the compensator inlet passage 122. When sufficient fluid enters the spool 181 through the inlets 186 at the inlet passage 122, the pressure within the first spool chamber 185 will overcome the bias of the spring 182 and the pilot pressure in the second spool chamber 188, thereby shifting the spool 181 towards the open end 121 of the compensator passage 120. As noted above, the pilot pressure in the second spool chamber 188 of the post-compensator arrangement 180 is provided by the second load sense chamber 127 of the chassis body 101, which is connected to the load sense line (e.g., load sense line 207 of FIGS. 3, 6, and 14) of the hydraulic system.

By shifting the spool 181 towards the open end 121, the outlets 187 of the first spool passage 185 start to open into the passage 123 of the chassis body 101. The first right blocking section 164 is positioned to inhibit any of the restricted, compensated fluid from flowing to the first work passage 114. Rather, the compensation outlet passage 123 connects to the cross-over passage 116 along a conduit disposed around the circumference of the first right blocking section 164. The compensated, restricted fluid flows through the cross-over passage 116, over the first left reduced section 173, and into the second work passage 115 to the second work port 105. As can be seen, the second left blocking section 174 blocks the compensated and restricted fluid from flowing to the return line 103.

The main spool 160 is configured to direct some the restricted, compensated fluid to the shuttle valve 192 to determine whether the second work port 105 has the higher load than the highest load received along the load sense line (load sense line 207 of FIGS. 3, 6, and 14) from the previous sub-sections. The first left reduced section 173 defines the inlet 178 to the left through-channel 177. Fluid enters the through-channel 177 through the inlet 178, flows towards the second side of the chassis body 101, and exits the through-channel 177 through the outlet 179. The outlet 179 aligns with the second load sense chamber inlet 118 that leads to the second load sense chamber passage 126, which connects to the shuttle valve 192.

As noted above, the shuttle valve 192 also receives an input from the load sense line received from previous sub-sections of the hydraulic system. If the load of the work port fluid (i.e., from work port 105) is more than the input load from the load sense line, then the shuttle valve 192 passes the load of the work port fluid on to the next sub-section via the load sense line. If the load of the work port fluid is less than the input load from the load sense line, however, then the shuttle valve 192 passes on the signal from the load sense line. Accordingly, the pressure received from the load sense line at the second load sense pilot pressure input location 127 is the highest pressure input to the load sense line from any of the post-compensation sub-sections.

The first right reduced section 165 of the main spool 130 enables fluid at the first work port 104 to flow through the first working passage 114, through the main spool passage 110, and into a return line outlet 103. While the entrance 170 of the right through-channel 169 is open to the fluid from the first work port 104, the outlet 171 is blocked by chassis body 101. Accordingly, the fluid from the first work port 104 is not passed to the shuttle valve 192 and does not influence the pilot pressure at the second load sense pilot pressure input location 127.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A hydraulic load sense flow control system that interfaces with a pump of a valve system, the hydraulic load sense flow control system including at least one valve section, each valve section comprising:

a valve body defining a main spool bore, a compensation spool bore, at least one inlet port, at least one return port, and at least one working port, the inlet port being configured to receive pump flow, the valve body including a drive circuit for directing pump flow from the inlet port to the working port, the valve body also defining first and second separate load sense pilot pressure input locations at the compensation spool bore, the valve body defining a load sense circuit for: a) determining a highest load sense pressure of the valve system based on a localized working pressure from each valve section of the valve system; b) communicating the highest load sense pressure to the second load sense pilot pressure input location; and c) communicating the localized working pressure of the valve section to the first load sense pilot pressure input location;

a directional flow control spool that mounts in the main spool bore for controlling the pump flow provided to the working port by the drive circuit; and a pressure compensation spool that mounts in the compensation spool bore for providing pressure compensation to the pump flow directed through the drive circuit, the pressure compensation spool having a first pilot surface that is in fluid communication with one of the first and second load sense pilot pressure input locations and that is blocked from fluid communication with the other of the first and second load sense pilot pressure input locations.

2. The hydraulic load sense flow control system of claim 1, wherein the pressure compensation spool comprises a pre-compensation spool that provides pressure compensation to the pump flow in the drive circuit before the pump flow has passed through a flow control orifice defined by the directional flow control spool that controls the pump flow provided to the working port, and wherein the first pilot surface is in fluid communication with the first load sense pilot pressure input location and is blocked from fluid communication with the second load sense pilot pressure input location.

3. The hydraulic load sense flow control system of claim 2, further comprising a spring that biases the pre-compensation spool in a direction toward a first position, and wherein pressure on the first pilot surface forces the pre-compensation spool in the first direction.

4. The hydraulic load sense flow control system of claim 3, wherein the first position is an open position wherein the pre-compensation spool provides fluid communication between the inlet port and the flow control orifice of the directional flow control spool, and wherein the pre-compensation spool is movable towards a second position where the pre-compensation spool starts to at least partially block fluid communication between the inlet port and the flow control orifice of the directional flow control spool.

5. The hydraulic load sense flow control system of claim 4, wherein the pre-compensation spool includes a second pilot surface configured such that pressure provided on the second pilot surface forces the pre-compensation spool in a second direction toward the second position, the second direction being opposite from the first direction, and the second pilot surface being in fluid communication with the drive circuit.

6. The hydraulic load sense flow control system of claim 2, wherein the load sense circuit passes across the directional flow control spool to communicate the localized working pressure of the working port to the first load sense pilot pressure input location.

7. The hydraulic load sense flow control system of claim 1, wherein the load sense circuit passes across the directional flow control spool to communicate the localized working pressure of the working port to the first load sense pilot pressure input location.

8. The hydraulic load sense flow control system of claim 1, wherein the load sense circuit keeps the second load sense pilot pressure input location in constant fluid communication with the determined highest load sense pressure.

9. The hydraulic load sense flow control system of claim 1, wherein the load sense circuit includes a flow path that extends from the first load sense pilot pressure input location to a passage carrying the determined highest load pressure and wherein a valve is positioned along the flow path for closing the flow path when the localized working pressure is less than the determined highest load pressure.

10. The hydraulic load sense flow control system of claim 1, wherein the pressure compensation spool comprises a post-compensation spool that provides compensation to the pump flow in the drive circuit after the pump flow has passed through a flow control orifice defined by the directional flow control spool that controls the pump flow provided to the working port, and wherein the first pilot surface is in fluid communication with the second load sense pilot pressure input location and is blocked from fluid communication with the first load sense pilot pressure input location.

11. The hydraulic load sense flow control system of claim 10, further comprising a spring that biases the post-compensation spool in a direction toward a first position, and wherein pressure on the first pilot surface forces the post-compensation spool in the first direction.

12. The hydraulic load sense flow control system of claim 11, wherein the first position is a closed position wherein the post-compensation spool blocks fluid communication between the flow control orifice of the directional flow control spool and the working port, and wherein the post compensation spool is movable towards a second position where the post compensation spool starts to open the fluid communication between the flow control orifice of the directional flow control spool and the working port.

13. The hydraulic load sense flow control system of claim 12, wherein the post-compensation spool includes a second pilot surface configured such that pressure provided on the second pilot surface forces the post-compensation spool in a second direction toward the second position, the second direction being opposite from the first direction, and the second pilot surface being in fluid communication with the drive circuit.

14. The hydraulic load sense flow control system of claim 10, wherein the load sense circuit passes across the directional flow control spool to communicate the localized working pressure of the working port to the first load sense pilot pressure input location.

15. The hydraulic load sense flow control system of claim 10, wherein the load sense circuit keeps the second load sense pilot pressure input location in constant fluid communication with the determined highest load sense pressure.

16. The hydraulic load sense flow control system of claim 1, wherein the hydraulic flow control system interfaces with a variable displacement pump.

17. The hydraulic load sense flow control system of claim 1, wherein the hydraulic flow control system interfaces with a fixed displacement pump.

18. A hydraulic load sense flow control valve section with pre-compensation for use in a valve system, the hydraulic load sense flow control valve section comprising:

a valve body defining a main spool bore and a compensation spool bore, the valve body including an inlet port, a tank port, a first working port, a second working port, and a load sense passage that carries a highest overall load pressure of the valve system, the valve body defining first and second pilot pressure input locations at the compensation spool bore;

a directional flow control spool mounted in the main spool bore, the directional flow control spool being movable to a first position where the second working port is placed in fluid communication with the tank port and a first orifice is defined for providing fluid communication between the first working port and the inlet port, the directional flow control spool also being movable to a second position where the first working port is placed in fluid communication with the tank port and a second orifice is defined for providing fluid communication between the second working port and the inlet port;

the first pilot pressure input location being in fluid communication with the first working port when the directional flow control spool is in the first position and being in fluid communication with the second working port when the directional flow control spool is in the second position;

the second pilot pressure input location being in constant fluid communication with the highest overall load pressure of the valve system; and a pre-compensation spool mounted in the compensation spool bore for providing pressure compensation to hydraulic fluid being pumped through the inlet port to the first and second orifices, the pre-compensation spool having a pilot surface in fluid communication with the first pilot pressure input location, the pre-compensation spool also having a blocking surface for blocking fluid communication between the pilot surface and the second pilot pressure input location.

19. The hydraulic load sense flow control valve section of claim 18, wherein the blocking surface defines an annular wall of the pre-compensation spool.

20. The hydraulic load sense flow control valve section of claim 18, wherein the pre-compensation spool is biased towards a closed end of the compensation spool bore by a spring.

21. A hydraulic load sense flow control valve section with post-compensation for use in a valve system, the hydraulic load sense flow control valve section comprising:

a valve body defining a main spool bore and a compensation spool bore, the valve body including an inlet port, a tank port, a first working port, a second working port, and a load sense passage that carries a highest overall load pressure of the valve system, the valve body defining first and second pilot pressure input locations at the compensation spool bore;

a directional flow control spool mounted in the main spool bore, the directional flow control spool being movable to a first position where the second working port is placed in fluid communication with the tank port and a first orifice is defined for providing fluid communication between the first working port and the inlet port, the directional flow control spool also being movable to a second position where the first working port is placed in fluid communication with the tank port and a second orifice is defined for providing fluid communication between the second working port and the inlet port;

the first pilot pressure input location being in fluid communication with the first working port when the directional flow control spool is in the first position and being in fluid communication with the second working port when the directional flow control spool is in the second position;

the second pilot pressure input location being in constant fluid communication with the highest overall load pressure of the valve system; and a post-compensation spool mounted in the compensation spool bore for providing pressure compensation to hydraulic fluid being pumped from the first and second orifices to the first and second working ports, the post-compensation spool having a pilot surface in fluid communication with the second pilot pressure input location, the post-compensation spool also having a blocking surface for blocking fluid communication between the pilot surface and the first pilot pressure input location.

22. The hydraulic load sense flow control valve section of claim 21, wherein the blocking surface defines an annular wall of the post-compensation spool.

23. The hydraulic load sense flow control valve section of claim 21, wherein the post-compensation spool is biased towards a closed end of the compensation spool bore by a spring.

24. A method of reconfiguring a hydraulic load sense flow control valve section comprising:

providing a valve body defining a main spool bore and a compensator spool bore, the compensator spool bore having a first load sense input location and a second load sense input location;

removing a first main spool from the main spool bore of the valve body;

removing a first pressure compensator spool arrangement from the compensator spool bore of the valve body, the first pressure compensator spool arrangement having at least one pilot hole that communicates with one of the first load sense input location and the second load sense input location;

inserting a second main spool into the main spool bore of the valve body, the second main spool having a different configuration from the first main spool; and inserting a second pressure compensator spool arrangement into the compensator spool bore of the valve body, the second pressure compensator arrangement having at least one pilot hole that communicates with the other of the first load sense input location and the second load sense input location.

25. The method of claim 24, further comprising operating the hydraulic valve section with the second main spool and the second pressure compensator spool arrangement without adjusting any other connections to the valve body.

26. The method of claim 24, wherein the first pressure compensator spool arrangement includes a pre-compensation spool and wherein the second pressure compensator spool arrangement includes a post-compensation spool.

27. The method of claim 24, wherein the first pressure compensator spool arrangement includes a post-compensation spool and wherein the second pressure compensator spool arrangement includes a pre-compensation spool.

* * * * *